US005621507A

United States Patent [19]

Nishimura et al.

[11] Patent Number: 5,621,507

[45] Date of Patent: Apr. 15, 1997

[54] ELECTROSTATIC LATENT IMAGE-DEVELOPING DEVICE AND TONER CARTRIDGE USED THEREFOR

[75] Inventors: Toshinori Nishimura; Yasuyuki Ishiguro; Akihiro Watanabe; Masahiro Higashitani, all of Osaka, Japan

[73] Assignee: Mita Industrial Co., Ltd., Osaka, Japan

[21] Appl. No.: 336,063

[22] Filed: Nov. 4, 1994

[30] Foreign Application Priority Data

| | | | |
|---|---|---|---|
| Nov. 30, 1993 | [JP] | Japan | 5-298825 |
| Jan. 14, 1994 | [JP] | Japan | 6-002559 |
| Jan. 14, 1994 | [JP] | Japan | 6-014944 |

[51] Int. Cl.[6] ..... G03G 15/06

[52] U.S. Cl. ..... 399/111; 222/DIG. 1; 399/262

[58] Field of Search ..... 355/245, 246, 355/260, 215; 118/653; 222/DIG. 1

[56] References Cited

U.S. PATENT DOCUMENTS

| | | | |
|---|---|---|---|
| 4,799,608 | 1/1989 | Oka | 222/DIG. 1 X |
| 4,998,140 | 3/1991 | Satou et al. | 355/245 |
| 5,030,998 | 7/1991 | Shibata et al. | 355/260 |
| 5,079,589 | 1/1992 | Shibata et al. | 355/245 |
| 5,142,335 | 8/1992 | Sakata et al. | 355/260 |
| 5,194,900 | 3/1993 | Hagihara et al. | 355/260 |
| 5,257,076 | 10/1993 | Nishimura et al. | 355/246 |
| 5,260,749 | 11/1993 | Yahata | 355/260 |
| 5,450,178 | 9/1995 | Kawashima et al. | 355/260 |

FOREIGN PATENT DOCUMENTS

| | | |
|---|---|---|
| 58-224364 | 12/1983 | Japan . |
| 4-343378 | 11/1992 | Japan . |
| 5-19625 | 1/1993 | Japan . |

*Primary Examiner*—Shuk Y. Lee

*Attorney, Agent, or Firm*—Beveridge, DeGrandi, Weilacher & Young, LLP

[57] ABSTRACT

An electrostatic latent image-developing device includes a toner cartridge provided with a container having a toner discharge opening, a toner contained in the container and a sealing tape for sealing the toner discharge opening, and a toner cartridge-holding device having a toner-receiving opening and allowing detachable mounting of the toner cartridge. The toner cartridge is equipped with a shutter member that is disposed on one edge side of the toner discharge opening and is so constituted as to move to the other edge side across the toner discharge opening to cover the toner discharge opening. The toner cartridge-holding device is equipped with a shutter-moving device which moves the front edge of the shutter member from one edge side to the other edge side of the toner discharge opening.

11 Claims, 22 Drawing Sheets

ELECTROSTATIC LATENT IMAGE-DEVELOPING DEVICE AND TONER CARTRIDGE USED THEREFOR

FIELD OF THE INVENTION

The present invention relates to an electrostatic latent image-developing device used for an image-forming machine such as an electrostatic copying machine or a laser printer. More specifically, the invention relates to an electrostatic latent image-developing device of a type which is replenished with toner by renewing a toner cartridge, and to the toner cartridge used for such an electrostatic latent image-developing device.

DESCRIPTION OF THE PRIOR ART

In an electrostatic latent image-developing device used in an image-forming machine, toner is imparted to an electrostatic latent image that is formed on a photosensitive material in order to develop it into a toner image. Therefore, the toner is consumed as the developing is continued, and the electrostatic latent image-developing device must be replenished with the toner after the developing has been executed many times. The toner is required to be replenished by means of an easy operation and for this purpose, in general, a toner replenishing system is employed according to which a toner cartridge is renewed to replenish the toner. The electrostatic latent image-developing device that employs the above toner replenishing system has a toner cartridge-holding means in which the toner cartridge is detachably held. The toner cartridge-holding means has an opening for receiving the toner. The toner cartridge includes a container having a toner discharge opening, toner contained in the container, and a sealing means for sealing the toner discharge opening. Usually, the toner discharge opening is formed in the lower wall of the container, and the sealing means is constituted by a tape member which is stuck to the lower wall of the container in a manner that it can be peeled off. When the toner cartridge is mounted on a predetermined mounting position of the toner cartridge-holding means, the toner discharge opening of the toner cartridge is positioned to face the opening for receiving the toner of the toner cartridge-holding means. After the toner cartridge is mounted on the predetermined position of the toner cartridge-holding means, the tape member is peeled off the container to open the toner discharge opening. Then, the toner in the container is discharged into the toner-receiving opening through the toner discharge opening, so that the electrostatic latent image-developing device is replenished with the toner. The tape member is peeled off the container usually by gripping its end and pulling it off.

When the toner is consumed and is to be replenished, the toner cartridge should cover again the toner discharge opening to prevent the residual toner from scattering. As technology that meets the above-mentioned requirement, Japanese Laid-Open Patent Publication No. 58-224364 discloses a toner cartridge in which a slide member is fitted to the container in relation to the toner discharge opening of the container, and the tape member stuck to the container is linked to the slide member. In the above toner cartridge, the slide member is moved in a predetermined direction relative to the container, whereby the tape member is peeled off the container and the toner discharge opening is opened. When the toner cartridge is to be removed from the toner cartridge-holding means, the slide member is returned back to the initial position to cover the toner discharge opening with the tape member.

In the toner cartridge disclosed in the above Japanese Laid-Open Patent Publication No. 58-224364, however, the toner discharge opening can be closed again by the tape member by returning the slide member back to the initial position, but it is not necessarily easy to return the slide member back to its initial position in a state where the toner cartridge is mounted on the predetermined mounting position of the toner cartridge-holding means. Further, at the time when the toner discharge opening is to be opened or closed, the portion that had been closing the toner discharge opening in the initial state is moved in an outwardly exposed state, i.e., the portion to where the toner is adhered in no small amount is moved in an outwardly exposed state, permitting the toner to scatter around. Moreover, the slide member moved from the toner discharge opening to one side of the container must be held at its position instead of being discarded away. This, however, causes the toner cartridge-holding means to become extremely bulky.

As technology for solving the above-mentioned problems, the present applicant has proposed an invention as disclosed in Japanese Laid-Open Patent Publication No. 5-19625. According to technology disclosed in this publication, a sealing means for sealing the toner discharge opening of the container is constituted by a tape member that is allowed to freely move across the toner discharge opening, a toner passage opening is formed in the tape member, and the toner passage opening is positioned at the toner discharge opening by moving the tape member, so that the toner is discharged from the container through the toner discharge opening and the toner passage opening formed in the toner cartridge-holding means.

According to technology disclosed in Japanese Laid-Open Patent Publication No. 5-19625 in which the toner passage opening is formed in the tape member that constitutes the sealing means, and the tape member is taken up when the cartridge is to be renewed after the toner in the container is consumed. In this case, however, the tape member is displaced toward the center or toward either side due to insufficient rigidity of the tape member at the toner passage opening, often making it difficult to reliably cover the toner discharge opening. Further, there still remains a problem in that the tape member may be broken at the toner passage opening.

Japanese Laid-Open Patent Publication No. 4-343378 discloses an electrostatic latent image-developing device of this type equipped with a toner conveying unit having a means for conveying the toner discharged from the toner cartridge to the developing unit, the toner conveying unit being provided with a toner amount detection means that detects the amount of the toner, in order to control the operation of the conveying means based upon a detection signal of the toner amount detection means and upon a detection signal of a toner concentration detection means that is disposed in the developing unit to detect the toner concentration of the developing agent.

When a toner concentration smaller than a predetermined control value is detected by the toner concentration detection means, operation of the conveying means is controlled to supply the toner to the developing unit. With the toner being fed to the developing unit as described above, the toner concentration of the developing agent usually restores to the predetermined control value. When the toner concentration does not reach the predetermined control value despite the operation of the conveying means is controlled, however, the image becomes defective due to the insufficient toner.

In the electrostatic latent image-developing device of this type, furthermore, when the cartridge is removed from the predetermined mounting position of the toner cartridge-holding means, there is exposed a conveying means which conveys to the developing unit the toner discharged from the toner cartridge that is placed just under the toner cartridge-holding means, through the toner-receiving opening formed in the toner cartridge-holding means. When the conveying means is operated in a state where the toner cartridge is taken out from the toner cartridge-holding means, therefore, the toner flies over through the toner-receiving opening and scatters around.

Moreover, the fluidity of the toner contained in the toner cartridge varies depending upon the weather conditions such as the temperature, humidity, etc. It is therefore desirable to use the toner of components suited for the climate of the regions where the device is used.

SUMMARY OF THE INVENTION

A principal object of the present invention is to provide an improved electrostatic latent image-developing device which is capable of easily and reliably closing the toner discharge opening to fully reliably prevent the toner remaining in the container from scattering around at the time of taking the toner cartridge out of the toner cartridge-holding means, and to provide a toner cartridge used for the above electrostatic latent image-developing device.

A second object of the present invention is to provide an electrostatic latent image-developing device which automatically moves the toner cartridge that is to be held in the toner cartridge-holding means from an attaching/detaching position to a predetermined mounting position and from the predetermined mounting position to the attaching/detaching position by the operator's instructions for the attachment or the detachment.

A third object of the present invention is to provide an improved electrostatic latent image-developing device which prevents the hands of the operator and the surrounding from being contaminated with the residual toner at a moment when the depleted toner cartridge is taken out from the toner cartridge-holding means.

A fourth object of the present invention is to provide an electrostatic latent image-developing device which produces an alarm to let the operator know the occurrence of trouble in the conveying means, trouble in the toner amount detector means, or occurrence of an abnormal state such as the continuous copying of an extremely dense document like a solid-black document in case the toner concentration of the developing agent does not reach the predetermined control value despite the operation of the conveying means is controlled and the toner exists in an amount in excess of a predetermined amount in the toner conveying unit.

A fifth object of the present invention is to provide an electrostatic latent image-developing device which is capable of reliably halting the operation of the conveyer means when the toner cartridge is removed from the predetermined mounting position of the toner cartridge-holding means.

A sixth object of the present invention is to provide an electrostatic latent image-developing device which, when a toner cartridge containing the toner that should be used in a different region of the country is mounted in the toner cartridge-holding means, makes it impossible to peel the sealing tape that seals the toner discharge opening of the toner cartridge, and urges the operator to replace the toner cartridge with a proper one.

In order to accomplish the above-mentioned principal object according to the present invention, there is provided an electrostatic latent image-developing device comprising:

a toner cartridge equipped with a container having a toner discharge opening, a toner contained in said container, and a sealing tape for sealing said toner discharge opening, and a toner cartridge-holding means having a toner-receiving opening and allowing detachably to mount said toner cartridge;

said toner discharge opening being positioned to face said toner-receiving opening when said toner cartridge is mounted on a predetermined mounting position of said toner cartridge-holding means; wherein said toner cartridge has a shutter member that is disposed on one edge side of said toner discharge opening and is so constituted as to move to the other edge side across said toner discharge opening thereby to cover said toner discharge opening, and said toner cartridge-holding means has a shutter-moving means that moves the front edge of said shutter member from one edge side to the other edge side of said toner discharge opening, In order to accomplish the above-mentioned second object according to the present invention, there is provided an electrostatic latent image-developing device comprising:

a toner cartridge equipped with a container having a toner discharge opening, a toner contained in said container, and a sealing tape for sealing said toner discharge opening;

a toner cartridge-holding means having a toner-receiving opening and allowing detachably to mount said toner cartridge;

a shutter member that is disposed on one edge side of said toner discharge opening of said toner cartridge and is so constituted as to move to the other edge side across said toner discharge opening thereby to cover said toner discharge opening;

a toner cartridge hoist means which moves said toner cartridge to an attaching/detaching position and to a predetermined mounting position;

a sealing tape take-up means for taking up said sealing tape;

a shutter-moving means that moves the front edge of said shutter member from one edge side to the other edge side of said toner discharge opening;

an instruction means for outputting a signal for attaching or detaching said toner cartridge; and a control means for controlling the operations of said toner cartridge hoist means, said sealing tape take-up means and said shutter-moving means based upon a signal from said instruction means;

wherein said control means, in response to a toner cartridge-mount signal from said instruction means, actuates said toner cartridge hoist means to move the toner cartridge to the predetermined mounting position and then, actuates said sealing tape take-up means to take up the sealing tape and, in response to a toner cartridge take-out signal, actuates said toner cartridge hoist means to bring the toner cartridge to a shutter-moving position that is elevated by a predetermined amount from the predetermined mounting position, then actuates said shutter-moving means to move the front edge of the shutter member from one edge side to the other edge side of said toner discharge opening, and then actuates said toner cartridge hoist means to bring the toner cartridge to the attaching/detaching position.

In order to accomplish the above-mentioned third object according to the present invention, furthermore, there is provided a toner cartridge comprising a container having a toner discharge opening, a toner contained in said container, a sealing member which is stuck to the peripheral edge of the toner discharge opening in a manner that it can be peeled off to seal said toner discharge opening, and a shutter member that is disposed on one edge side of said toner discharge opening and is so constituted as to move to the other edge side across said toner discharge opening.

In order to accomplish the above-mentioned fourth object according to the present invention, there is provided an electrostatic latent image-developing device comprising:

a toner cartridge equipped with a container having a toner discharge opening;

a toner cartridge-holding means having a toner-receiving opening and allowing detachably to mount said toner cartridge;

a toner conveying unit having a conveying means that conveys the toner discharged from the toner cartridge to the developing unit; and the developing unit where a developing agent is constituted by a toner conveyed by the toner conveying unit and carriers;

and further comprising:

a toner concentration detection means that is disposed in said developing unit to detect the toner concentration in said developing agent;

a toner amount detection means that is disposed in said toner conveying unit to detect the amount of the toner in said toner conveying unit; and a control means which controls the operation of said conveying means based upon detection signals from said toner concentration detection means and from said toner amount detection means;

wherein said control means controls the operation of said conveying means in a predetermined toner replenishing mode when a toner concentration signal from said toner concentration detection means represents an empty concentration which is smaller than a predetermined control value by more than a predetermined amount, and produces an alarm when the toner concentration signal does not reach said control value within a predetermined period of time or when the toner amount signal from said toner amount detection means is larger than a predetermined value.

In order to accomplish the above-mentioned fifth object according to the present invention, there is provided an electrostatic latent image-developing device comprising:

a toner cartridge equipped with a container having a toner discharge opening, a toner contained in said container, and a sealing tape for sealing said toner discharge opening;

a toner cartridge-holding means having a toner-receiving opening and allowing detachably to mount said toner cartridge; and a conveying means for conveying the toner discharged from said toner cartridge to a developing unit;

wherein said toner cartridge-holding means is provided with a toner cartridge mount detection switch that is opened and closed by the attachment or detachment of said toner cartridge, and said toner cartridge mount detection switch is inserted in an electric circuit that feeds electric power to an electric motor that drives said conveying means.

In order to accomplish the above-mentioned sixth object according to the present invention, furthermore, there is provided an electrostatic latent image-developing device comprising:

a toner cartridge equipped with a container having a toner discharge opening, a toner contained in said container, a sealing tape for sealing said toner discharge opening, and a take-up shaft for taking up said sealing tape; and a toner cartridge-holding means having a toner-receiving opening and allowing detachably to mount said toner cartridge;

wherein said toner cartridge-holding means is equipped with a toner cartridge mount detection switch that is disposed at a predetermined position that has been set depending upon a region where the device is to be used and is inserted in an electric circuit for feeding electric power to an electric motor that drives said take-up shaft; and said toner cartridge is equipped with an operation piece that is disposed at a predetermined position that has been set depending upon a region where the device is to be used and closes said toner cartridge mount detection switch in a state where said toner cartridge is mounted on a predetermined mounting position of said toner cartridge-holding means.

Other objects and features of the present invention will become obvious from the following description.

DETAILED DESCRIPTION OF THE PREFERRED EMBODIMENTS

A preferred embodiment of the electrostatic latent image-developing device constituted according to the present invention will now be described in further detail with reference to the accompanying drawings.

Figure 1:
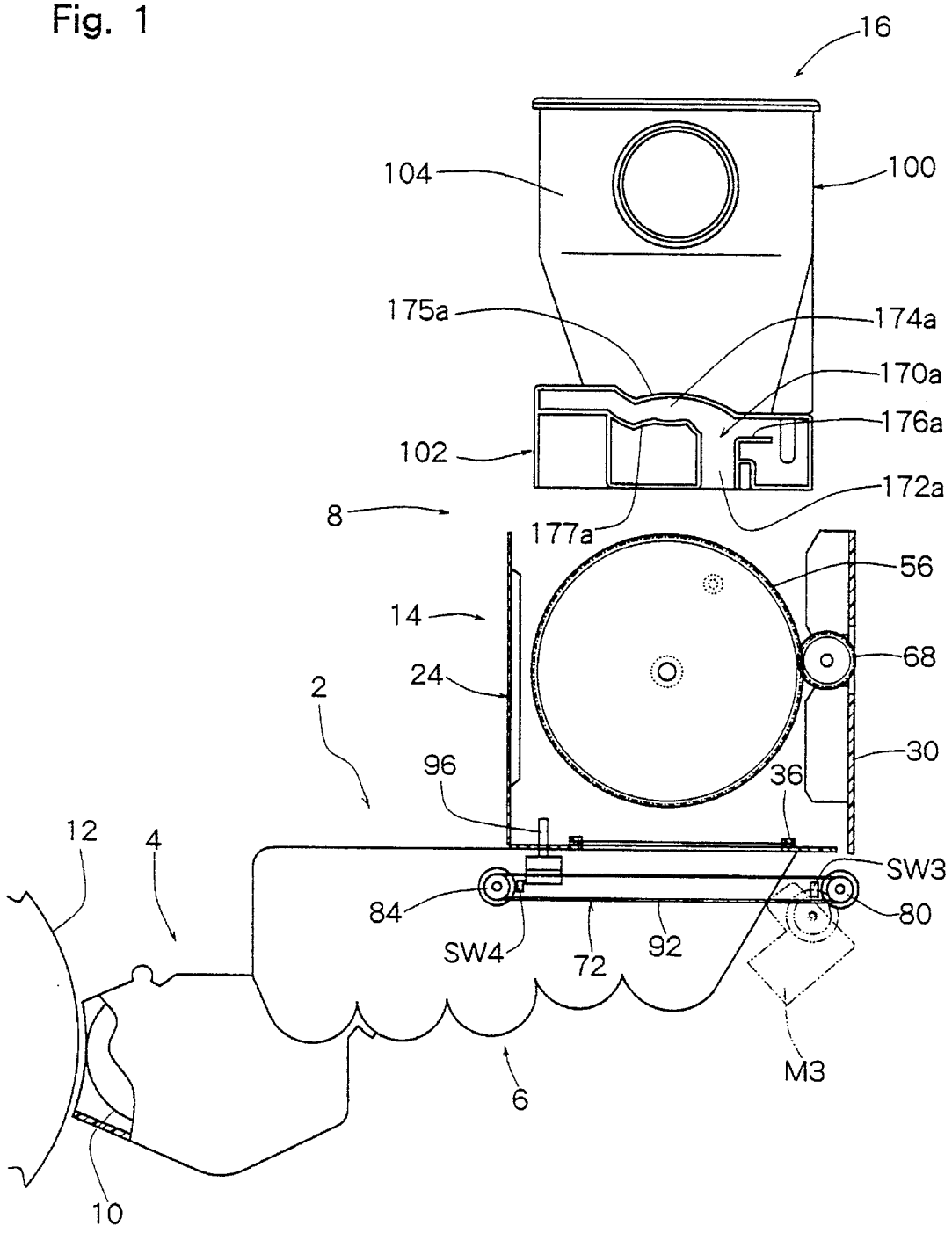
FIG. 1 is a side view illustrating, partly in cross section, a preferred embodiment of an electrostatic latent image-developing device constituted according to the present invention, with a disassembling toner cartridge.
Figure 2:
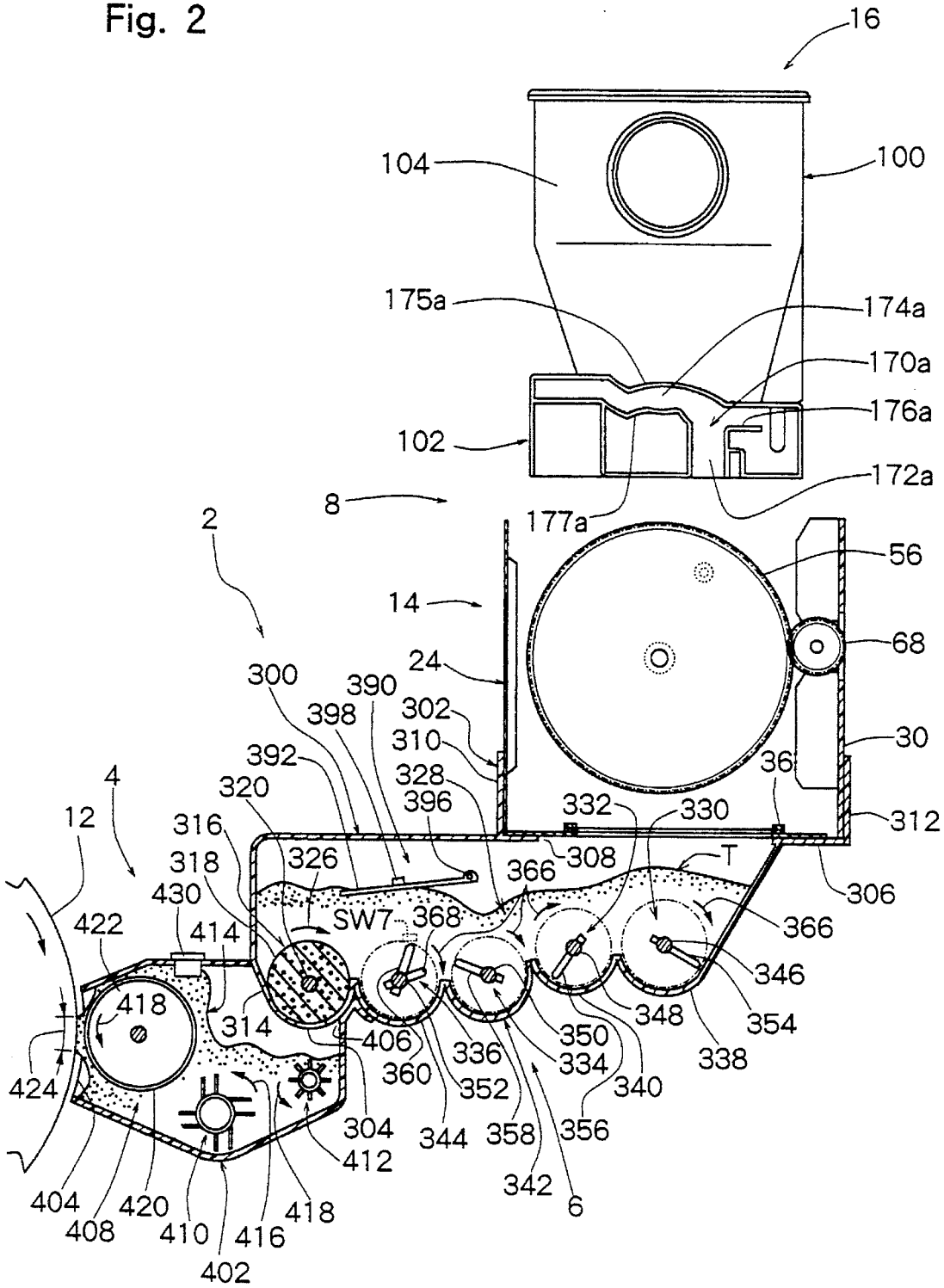
FIG. 2 is a side view illustrating, in cross section, a developing unit and a toner conveying unit in the electrostatic latent image-developing device shown in FIG. 1.
Figure 5:
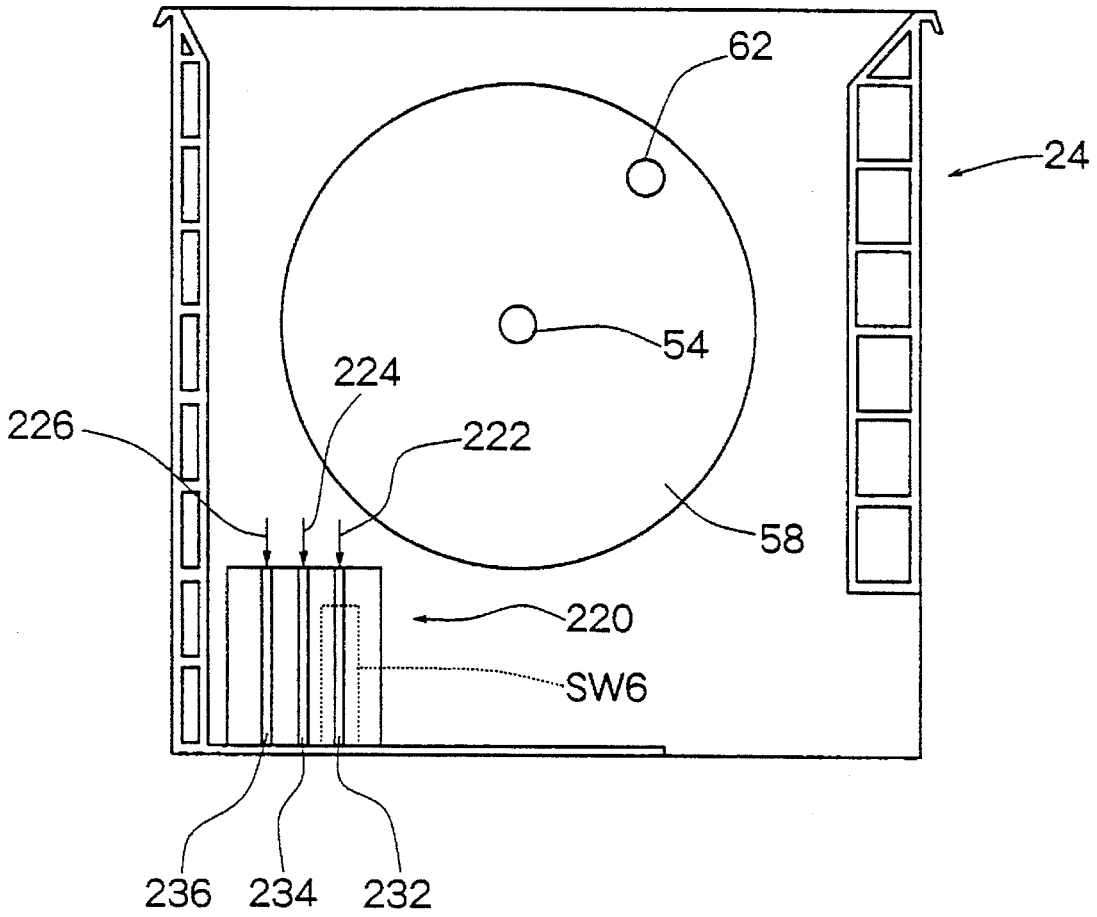
FIG. 5 is a sectional view of the toner cartridge-holding means along the line A—A in FIG. 2.

With reference to FIGS. 1 and 2, an electrostatic latent image-developing device generally designated at 2 is constituted by a developing unit 4, a toner conveying unit 6, and a toner feeding unit 8. The toner feeding unit 8 is equipped with a toner cartridge-holding means 14 and a toner cartridge 16 that is detachably mounted on the toner cartridge-holding means 14. As will be described later in further detail, the toner T is contained in the toner cartridge 16 as shown in FIG. 5 and is discharged into the toner conveying unit 6. The electrostatic latent image-developing device 2 and a rotary drum 12 are disposed in a housing (not shown) of an image-forming machine such as an electrostatic copying machine or a laser printer.

Figure 3:
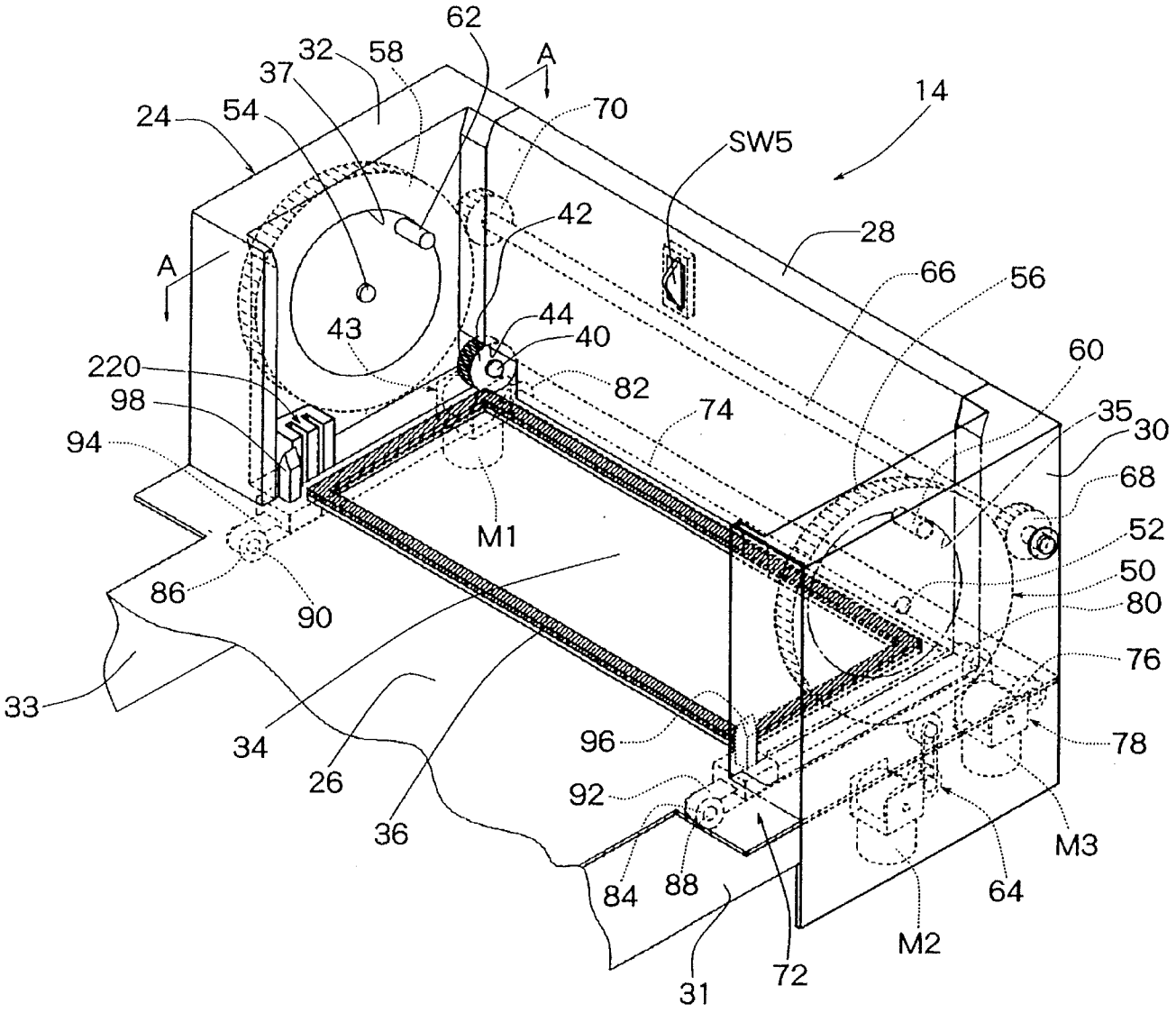
FIG. 3 is a perspective view illustrating major portions of a toner cartridge-holding means in the electrostatic latent image-developing device shown in FIG. 1.

With reference to FIG. 3 as well as FIGS. 1 and 2, the toner cartridge-holding means 14 of the toner feeding unit 8 includes a stationary support frame 24. This support frame 24 has a bottom wall 26 that extends substantially horizontally, an upright rear wall 28 that upwardly extends from the rear edge of the bottom wall 26, and upright side walls 30 and 32 that upwardly extend from edges on both sides of the bottom wall 26. The upright rear wall 28 and the upright side walls 30, 32 have a double-wall structure defining space between the walls. A toner-receiving opening 34 having a rectangular shape in the direction of width (direction perpendicular to the surface of the paper in FIG. 1) is formed in the central region of the bottom wall 26. A sealing member 36 made of a buffer material is attached to the upper surface of the bottom wall 26 along the peripheral edge of the toner-receiving opening 34. The sealing member 36 is made of a soft material such as a foamed resin. A short shaft 40 that horizontally protrudes is secured to the rear portion of the side wall 32, and a gear 42 that constitutes a sealing tape take-up means is rotatably fitted to the shaft 40. The gear 42 is connected to an electric motor M1 which is a drive source via a transmission means 43 that includes a gear train. A rectangular notch 44 is formed in the lower inner side of the rear wall 28, and the gear 42 is allowed to protrude forward through the notch 44. As will be described later, the gear 42 constitutes an output means that is drivably coupled to an input means constituted by gears that are disposed in the toner cartridge 16.

Figure 4:
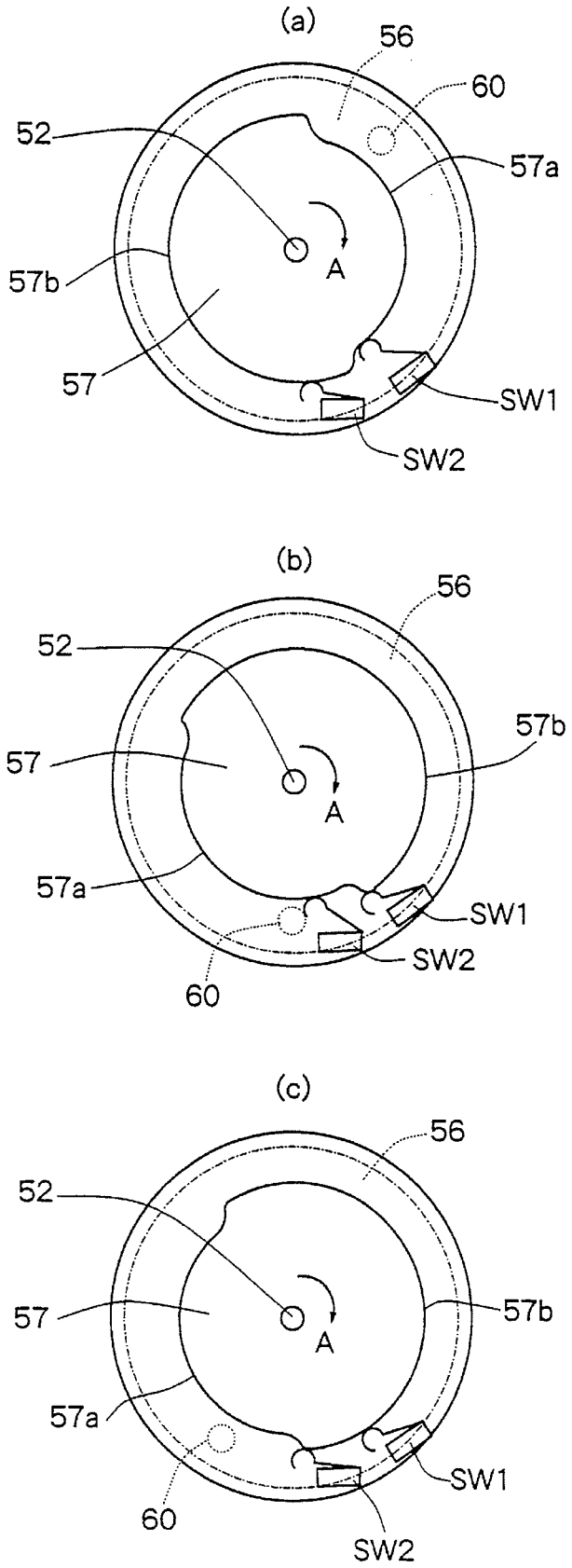
FIG. 4 is a front view illustrating the sequence of operation of a hoist pin position detection means in a hoist means provided for the toner cartridge-holding means in the electrostatic latent image-developing device shown in FIG. 1.

The toner cartridge-holding means 14 has a hoist means 50 for hoisting the toner cartridge 16. The hoist means 50 includes hoist gears 56 and 58 that are rotatably supported by the short shafts 52 and 54 on the side walls 30 and 32. Hoist pins 60 and 62 that inwardly protrude substantially horizontally are disposed on the inner sides of the hoist gears 56 and 58 that are opposed to each other. One hoist gear 56 is coupled to an electric motor M2 which is a drive source via a power transmission mechanism 64 such as a gear mechanism, a timing belt mechanism or the like mechanism. Circular openings 35 and 37 are formed in the inner side walls that are constituting the side walls 30 and 32 to permit the turning of hoist pins that will be described later. The hoist gears 56 and 58 are engaged with coupling gears 68 and 70 that are fitted to both ends of a coupling shaft 66 that is disposed in the rear wall 28 and is rotatably supported by the side walls 30 and 32. Therefore, when the hoist gear 56 is driven by the driving force of the electric motor M2 via the power transmission mechanism 64, the driving force is transmitted to the hoist gear 58 via coupling gear 68, coupling shaft 66 and coupling gear 70, so that the hoist gear 58 revolves at the same speed as the hoist gear 56. Here, as shown in FIG. 4, the hoist gear 56 is equipped with a cam 57 that constitutes a hoist pin position detection means on the outside surface thereof. First and second hoist pin position detection switches SW1 and SW2 are disposed being opposed to the cam 57. When the toner cartridge 16 is at the attaching/detaching position, the cam 57 and the two hoist pin position detection switches SW1 and SW2 establish a positional relationship as shown in FIG. 4(*a*) whereby the first hoist pin position detection switch SW1 engages with a small-diameter portion 57*a* of the cam 57 and is turned off, and the second hoist pin position detection switch SW2 engages with a large-diameter portion 57*b* of the cam 57 and is turned on. In a state shown in FIG. 4(*b*) where the hoist pin 60 is located at the lowest point, i.e., located at the mounting position as a result of the turn of the hoist gear 56 in the direction of arrow from the state of FIG. 4(*a*), the first hoist pin position detection switch SW1 engages with the large-diameter portion 57*b* of the cam 57 and is turned on and the second hoist pin position detection switch SW2 engages with the small-diameter portion 57*a* of the cam 57 and is turned off. At a position where the hoist gear 56 has turned by about 30° in the direction of arrow from the state shown in FIG. 4(*b*), i.e., at a position where the shutter has moved as shown in FIG. 4(*c*), the second hoist pin position detection switch SW2 engages with a large-diameter portion 57*b* of the cam 57 and is turned on.

The toner cartridge-holding means 14 is equipped with a shutter-moving means 72 which includes a drive shaft 74 disposed on the lower side of the bottom wall 26 at the rear end of the toner cartridge-holding means 14. The drive shaft 74 is rotatably supported by side walls 31 and 33 that are formed protruding from the lower surface of the bottom wall 26, and is fitted with a gear 76 which is coupled to an electric motor M3 which is a driving source via a power transmission mechanism 78 such as a gear mechanism or the like mechanism. The drive shaft 74 has pulleys 80 and 82 at both ends thereof. The pulleys 80 and 82 are attached to the drive shaft 74 so as to be located on the outer side of both side edges of the rectangular toner-receiving opening 34. Furthermore, pulleys 84 and 86 are disposed in front of the toner-receiving opening 34 on the lower side of the bottom wall 26 so as to be opposed to the pulleys 80 and 82. The pulleys 84 and 86 are rotatably fitted to the short shafts 88 and 90 provided on the side walls 31 and 33. Timing belts 92 and 94 are respectively wrapped round the pulleys 80, 84 and the pulleys 82, 86, and shutter sliders 96 and 98 are mounted on the timing belts 92 and 94. With the operation of the timing belts 92 and 94, therefore, the shutter sliders 96 and 98 move between the pulley 80 and the pulley 84 and between the pulley 82 and the pulley 86, causing the shutter member that will be described later to move when they move from the side of the pulleys 80 and 82 toward the side of the pulleys 84 and 86. In relation to the movement of the shutter slider 96, first and second slider position detection switches SW3 and SW4 are disposed on the side of the pulley 80 and on the side of the pulley 84 as shown in FIG. 1. The first slider position detection switch SW3 is turned on when the shutter slider 96 arrives at a predetermined position on the side of the pulley 80, and the second slider position detection switch SW4 is turned on when the shutter slider 96 is returned back to a predetermined position on the side of the pulley 84 from the side of the pulley 80. A toner cartridge detection switch SW5 is disposed on the rear wall 28 of the toner cartridge-holding means 14.

The toner cartridge-holding means 14 is equipped with a switch-holding case 220 for holding a toner cartridge mount detection switch that will be described later at a lower portion on the inside of the upright side wall 32. In the illustrated embodiment as shown in FIG. 5, the switch-holding case 220 has three set positions 222, 224 and 226, so that the toner cartridge mount detection switch SW6 can be disposed at a different position depending upon a region where the device will be used. The toner cartridge mount detection switch SW6 is disposed at one of these set positions depending upon a region where the device will be used. In the illustrated embodiment, the toner cartridge mount detection switch SW6 is disposed at the set position 222. In the switch-holding case 220 are formed open grooves 232, 234 and 236 that permit the passage of an operation piece that will be described later in order to open or close the toner cartridge mount detection switch SW6.

Figure 6:
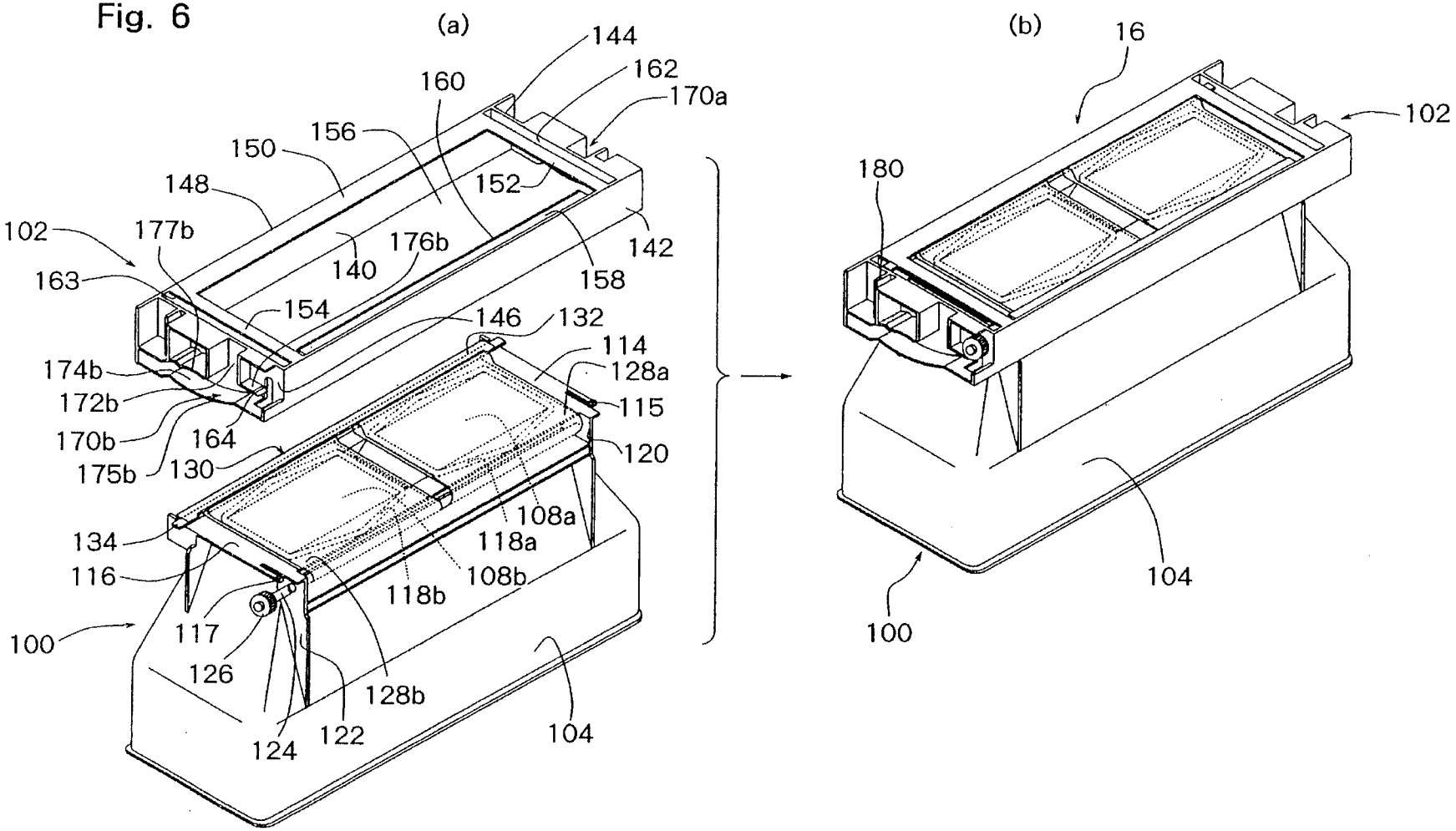
FIG. 6 is a perspective view illustrating the toner cartridge in a disassembled state and in an assembled state as viewed from the bottom, that is used in the electrostatic latent image-developing device shown in FIG. 1.

The toner cartridge 16 will now be described with reference to FIGS. 6 to 9 as well as FIG. 1. The illustrated toner cartridge 16 is equipped with a plastic container 100 which as a whole is made of a single unit or by joining two or more components together, and a base unit 102 attached to the lower end of the plastic container 100. FIG. 6(*a*) is a perspective view of when the plastic container 100 and the base unit 102 in a disassembled state are viewed from the bottom, and FIG. 6(*b*) is a perspective view of when the toner cartridge 16 made up of the plastic container 100 and the base unit 102 is an assembled state is viewed from the bottom. The container 100 constituting the toner cartridge 16 has a box-like main portion 104 which contains the toner T. The upper half of the main portion 104 is of a rectangular parallelopiped shape, and the lower half portion thereof has a truncated pyramidal portion and a relatively small rectangular parallelopiped portion continuous thereto. In other words, in the lower half of the main portion 104, the four side walls downwardly extend with inward inclination and then downwardly extend substantially vertically. Two toner discharge openings 108*a* and 108*b* are formed side by side in the direction of width (in a direction perpendicular to the surface of the paper in FIG. 6 or in a direction of from the lower left to the upper right) in the lower wall 106 of the main portion 104. The toner discharge openings 108*a* and 108*b* may have a rectangular shape. As will be easily comprehended with reference to FIG. 7, the lower wall 106 has a front extended portion 110 and a rear extended portion 112 that extend forwardly and rearwardly. As shown in FIG. 6, furthermore, the lower wall 106 has side extended portions 114 and 116, and engaging pawls 115 and 117 are formed at the rear ends thereof. The container 100 further has an intermediate wall 119 that extends in the direction of width over the rear extended portion 112 that constitutes the lower wall 106. As clearly shown in FIG. 6, melt-adhesion protrusions 118*a* and 118*b* are formed in the lower wall 106 to surround the toner discharge openings 108*a* and 108*b*. Both side portions of the melt-adhesion protrusions 118*a* and 118*b* extend straight, but the front portions and the rear portions extend forwardly and backwardly in a tilted manner from both sides thereof toward the center in the direction of width to protrude forward and backward in a triangular shape. When the toner cartridge 16 is mounted on a predetermined position of the toner cartridge-holding means 14, the toner discharge openings 108*a* and 108*b* are faced to the toner-receiving opening 34 formed in the bottom wall 26. The toner-receiving opening 34 formed in the bottom wall 26 is larger than the toner discharge openings 108*a* and 108*b* and, hence, the lower wall 106 of the container 100 defines a space S relative to the inner side of the press-contact portion that comes into contact with the sealing member 36 fitted along the peripheral edge of the toner-receiving opening 34, i.e., defines a space S between the toner discharge openings 108*a* and 108*b*.

Figure 7:
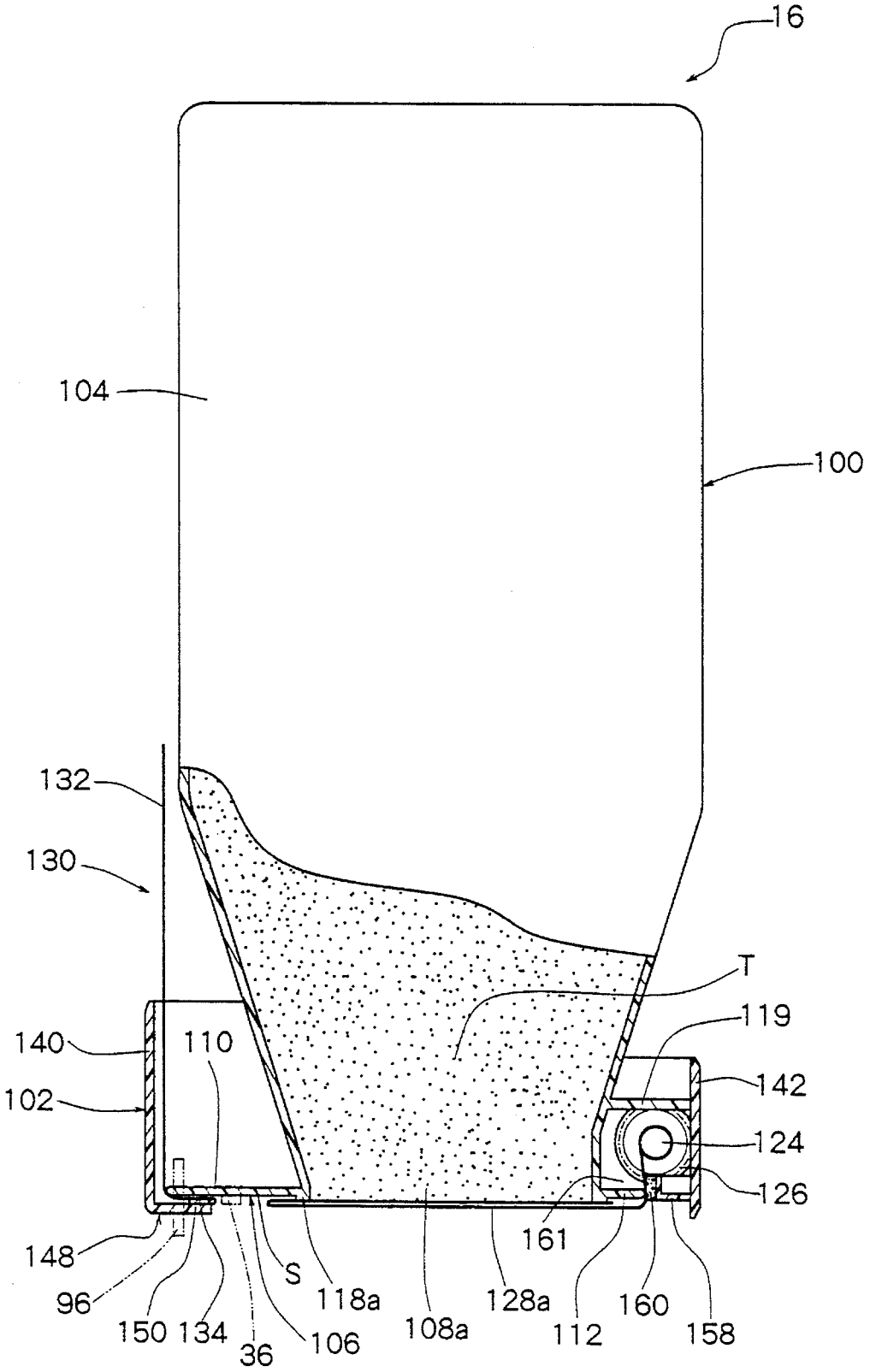
FIG. 7 is a sectional view of the toner cartridge shown in FIG. 6.

With reference to FIGS. 6 and 7, on both sides at the lower end of the rear wall of the plastic container 100 are formed upright walls 120 and 122 that connect to the side extended portions 114 and 116. On the upright walls 120 and 122 on both sides is rotatably mounted a take-up shaft 124 that constitutes the take-up means over the rear extended portion 112 of the lower wall 106. The take-up shaft 124 extends in the direction of width along the toner discharge openings 108*a* and 108*b*, and its one end outwardly protrudes penetrating through the side upright wall 122 and has a gear 126 fitted thereto. As will be described later, the gear 126 constitutes an input means that is drivably coupled to the gear 42 disposed in the toner cartridge-holding means 14.

The toner cartridge 16 is further equipped with sealing tapes 128*a* and 128*b* arranged in relation to the toner discharge openings 108*a* and 108*b*. The sealing tapes 128*a* and 128*b* are arranged inside the press-contact portion that comes into contact with the sealing member 36, i.e., arranged inside the space S. The sealing tapes 128*a* and 128*b* are made of a suitable plastic film. The sealing tapes 128*a* and 128*b* are fitted at the ends on one side to the rear extended portion 112, extend forward along the lower wall 106, and reach the front extended portion 110 covering the toner discharge openings 108*a* and 108*b*. The sealing tapes 128*a* and 128*b* extending along the lower wall 148 and covering the toner discharge openings 108*a* and 108*b*, are stuck to the lower wall 106 in a manner that they can be peeled. The sticking is favorably accomplished in a manner in a manner that it can be peeled by heat melt-adhering the sealing tapes 128*a* and 128*b* onto the melt-adhesion protrusions 118*a* and 118*b* that are formed on the outer surface of the lower wall 106. The sealing tapes 128*a* and 128*b* are folded back at the front side (left side in FIG. 7) of the toner discharge openings 108*a* and 108*b* to extend rearwardly, pass along the back of the rear extended portion 112, and are coupled at the edges on the other side to a take-up shaft 124 that constitutes the take-up means.

With reference to FIGS. 6 and 7, the toner cartridge 16 is equipped with a shutter member 130 which comprises a shutter sheet 132 and an engaging member 134 attached to the tip of the shutter sheet 132. The shutter sheet 132 is made of a suitable plastic film having rigidity greater than that of the sealing tapes 128*a* and 128*b*, and has a width which is large enough for covering the toner discharge openings 108*a* and 108*b*. The engaging member 134 is made of a plastic material having rigidity, has a length longer than the width of the shutter sheet 132, and is melt-adhered to the tip of the shutter sheet 132 with its both ends that outwardly protrude. The thus constituted shutter member 130 has the engaging member 134 that is disposed on the outside (left side in FIG. 7) of the portion press-contacted to the sealing member 36 and on the rear side (right side in FIG. 7) of the shutter sliders 96 and 98 under the front extended portion 110 of the plastic container 100, and has its other end that is upwardly extended passing by the front end of the front extended portion 110 and is anchored.

As shown in FIGS. 6 and 7, a base unit 102 that is fitted to the lower end of the plastic container 100 is made of a plastic material, has a front wall 140, a rear wall 142, side walls 144, 146, and a bottom wall 148, and has an opening 156 that is formed in the bottom wall 148 and that is larger than the toner discharge openings 108*a* and 108*b*. The base unit 102 is fitted to the lower end of the plastic container 100 and is assembled together with the container 100. The rear wall 142 defining the rear edge of the opening 156 of the base unit 102 has a flange 158 that is formed in the direction of width being opposed to the rear end of the rear extended portion 112 of the plastic container 100, and has a wiping sponge 160 fitted to the front surface thereof. Here, the rear wall 142 of the base unit 102, flange 158 and wiping sponge 160 constitute a closed space 161 over the lower wall in cooperation with the rear extended portion 112 constituting the lower wall 106 of the container 100, intermediate wall 119 and upright walls 120, 122 on both sides, and a take-up portion of the take-up shaft 124 is disposed in this closed space 161. A front portion 150 of the bottom wall 148 supports the engaging member 134 of the shutter member 130, and both side portions 152 and 154 of the bottom wall 148 work to guide the engaging member 134 when the shutter member 130 is moved. Moreover, elongated guide holes 162 and 163 that extend from the front wall 140 up to the rear wall 142 are formed in both side portions 152 and 154 constituting the bottom wall 148. This permits the shutter sliders 96 and 98 to move. An elongated hole 164 is formed in one side wall 146 that constitutes the base unit 102, and the take-up shaft 124 is fitted thereto.

The base unit 102 has cam grooves 170*a* and 170*b* with which will engage the hoist pins 60 and 62 attached to the hoist gears 56 and 58 that constitute the hoist means 50 on the side walls 144 and 146. As for the cam groove 170*a*, FIG. 1 is referred to. The cam grooves 170*a* and 170*b* have inlet/exit portions 172*a* and 172*b* that perpendicularly extend from the lower ends and moving portions 174*a* and 174*b* that are continuous to the upper ends of the inlet/exit portions 172*a* and 172*b* and extend nearly in the horizontal direction. The moving portions 174*a* and 174*b* are defined by upper walls 175*a* and 175*b*, first lower walls 176*a* and 176*b*, and second lower walls 177*a* and 177*b*. The side wall 146 in which the cam groove 170*b* of the base portion 102 is formed has an operation piece 180 formed at a position corresponding to the toner cartridge mount detection switch SW6 that is disposed at the set position 222 of the switch-holding case 220 of the toner cartridge-holding means 14. Like the position of the toner cartridge mount detection switch SW6, the operating piece 180 is disposed at a position that corresponds to the set position 222, 224 or 226 depending upon the region where the device will be used. In the illustrated embodiment, the operation piece 180 is formed at a position that corresponds to the set position 222.

Figure 8:
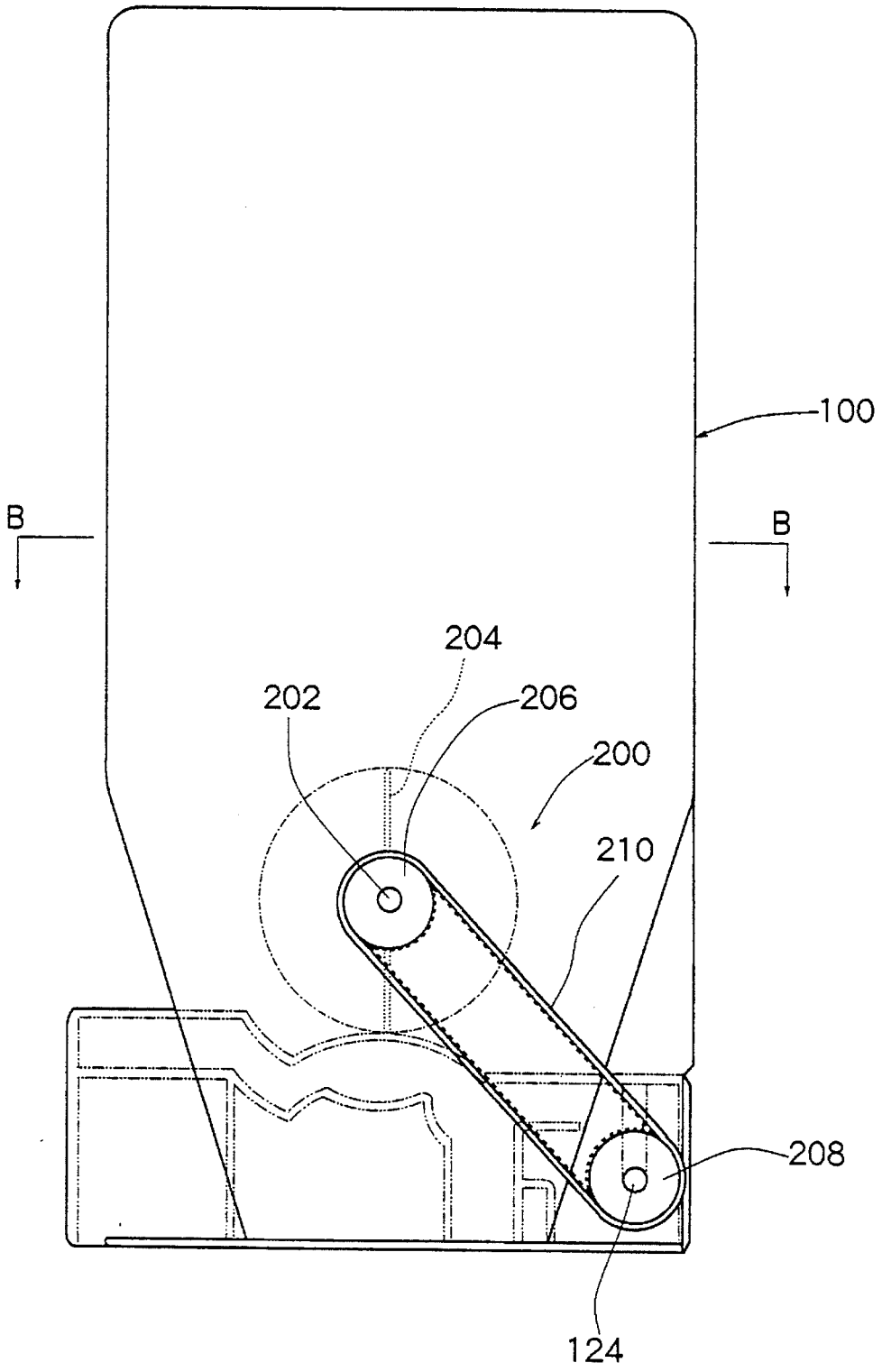
FIG. 8 is a side view of the toner cartridge shown in FIG. 6.
Figure 9:
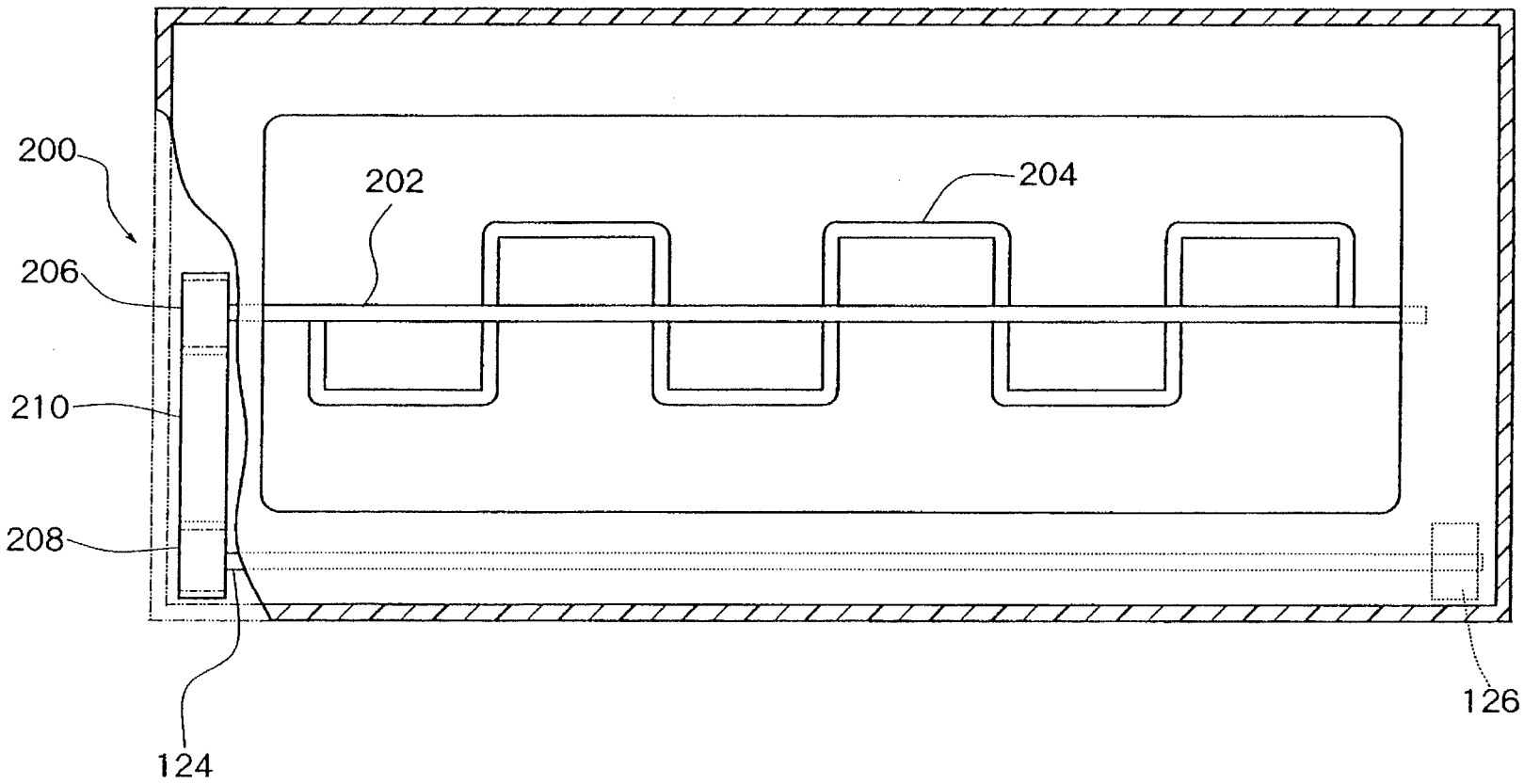
FIG. 9 is a sectional view of the toner cartridge along the line B—B in FIG. 6.

As seen from FIGS. 8 and 9, the toner cartridge 16 is equipped with a toner solidification-prevention means 200 that is drivably coupled to the take-up shaft 124. The toner solidification-prevention means 200 has a rotary shaft 202 at a lower central portion of the container 100 constituting the toner cartridge 16, the rotary shaft 202 being arranged in parallel with the take-up shaft 124 and penetrating through the container. The rotary shaft 202 is provided with a stirrer member 204 that is alternatingly formed in a bent shape so as to stir the toner contained in the container 100. In the illustrated embodiment, the rotary shaft 202 and the stirrer member 204 are formed as a unitary structure and are made of a plastic material. To an end of the rotary shaft 202 is fitted a driven toothed pulley 206. A driving toothed pulley 208 is fitted to an end of the take-up shaft 124 on the side opposite to the end to where the gear 126 is attached, a toothed belt 210 is wrapped round the driving toothed pulley 208 and the driven toothed pulley 206, and the driving force for rotating the take-up shaft 124 is transmitted to the rotary shaft 202 to which the stirrer member 204 is attached, via driving toothed pulley 208, toothed belt 210 and driven toothed pulley 206.

Figure 10:
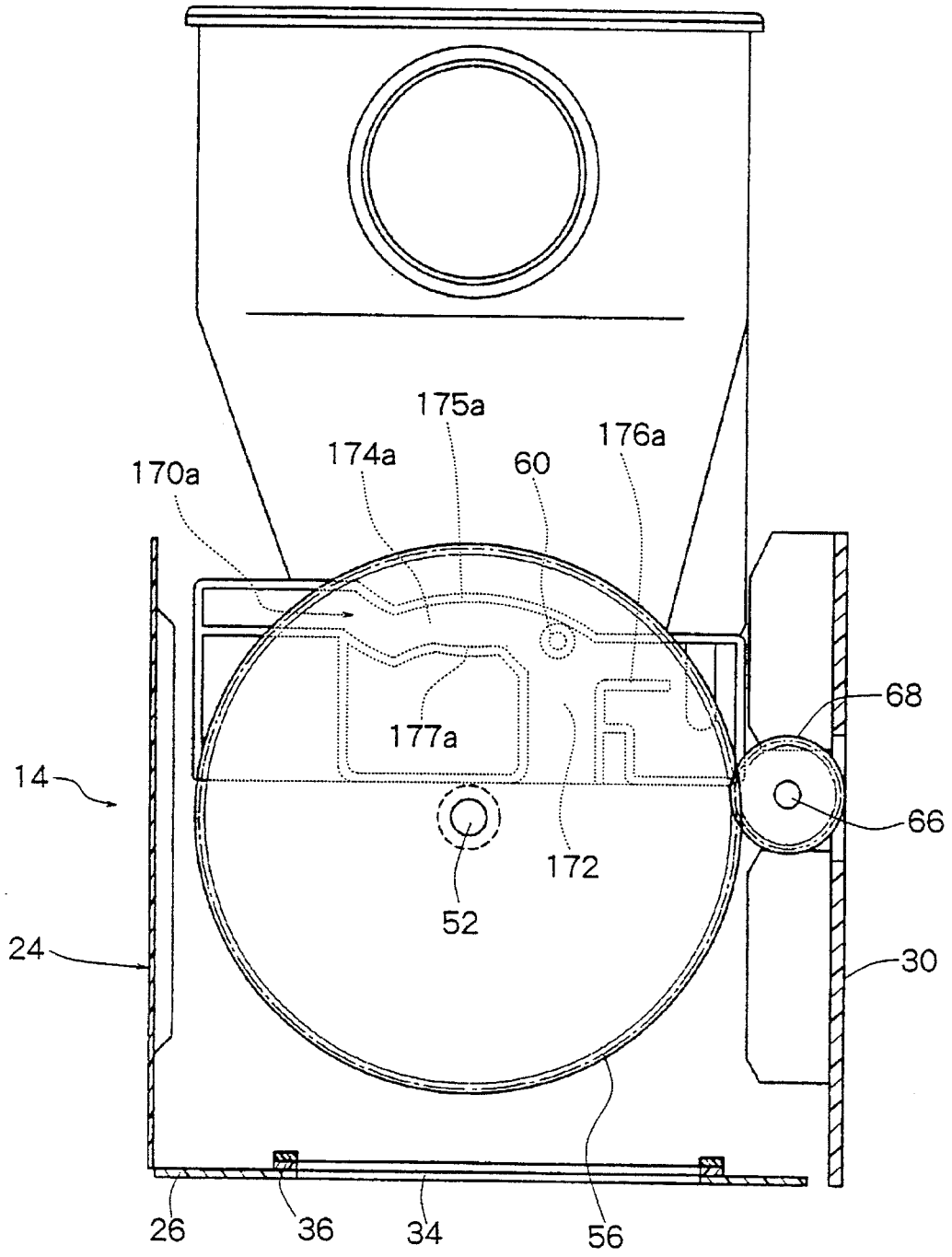
FIG. 10 is an illustration of the hoist means in a state where the toner cartridge is inserted in the toner cartridge-holding means in the electrostatic latent image-developing device shown in FIG. 1.
Figure 11:
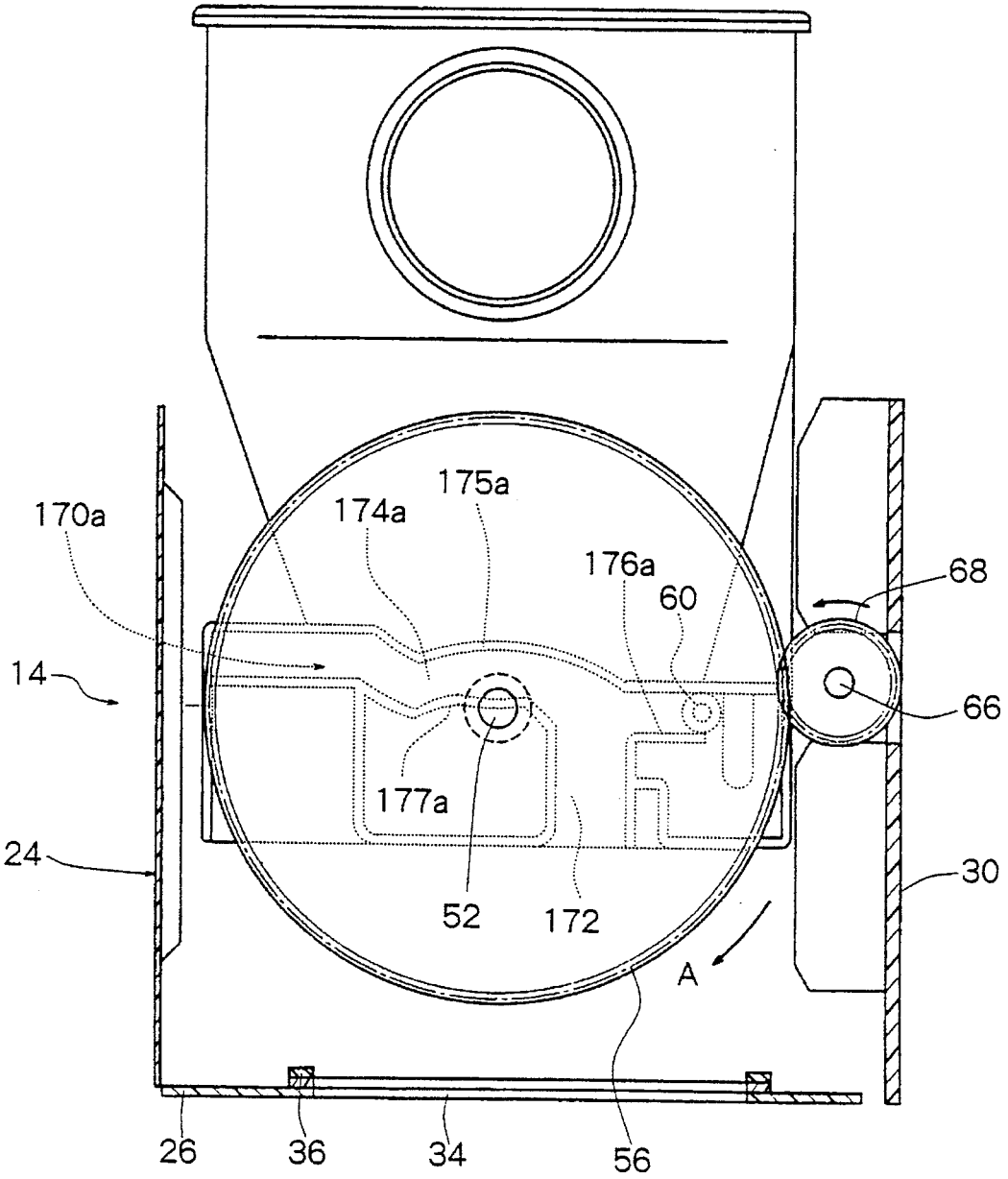
FIG. 11 is an illustration of the hoist means in a state where the toner cartridge inserted in the toner cartridge-holding means starts descending in the electrostatic latent image-developing device shown in FIG. 1.
Figure 12:
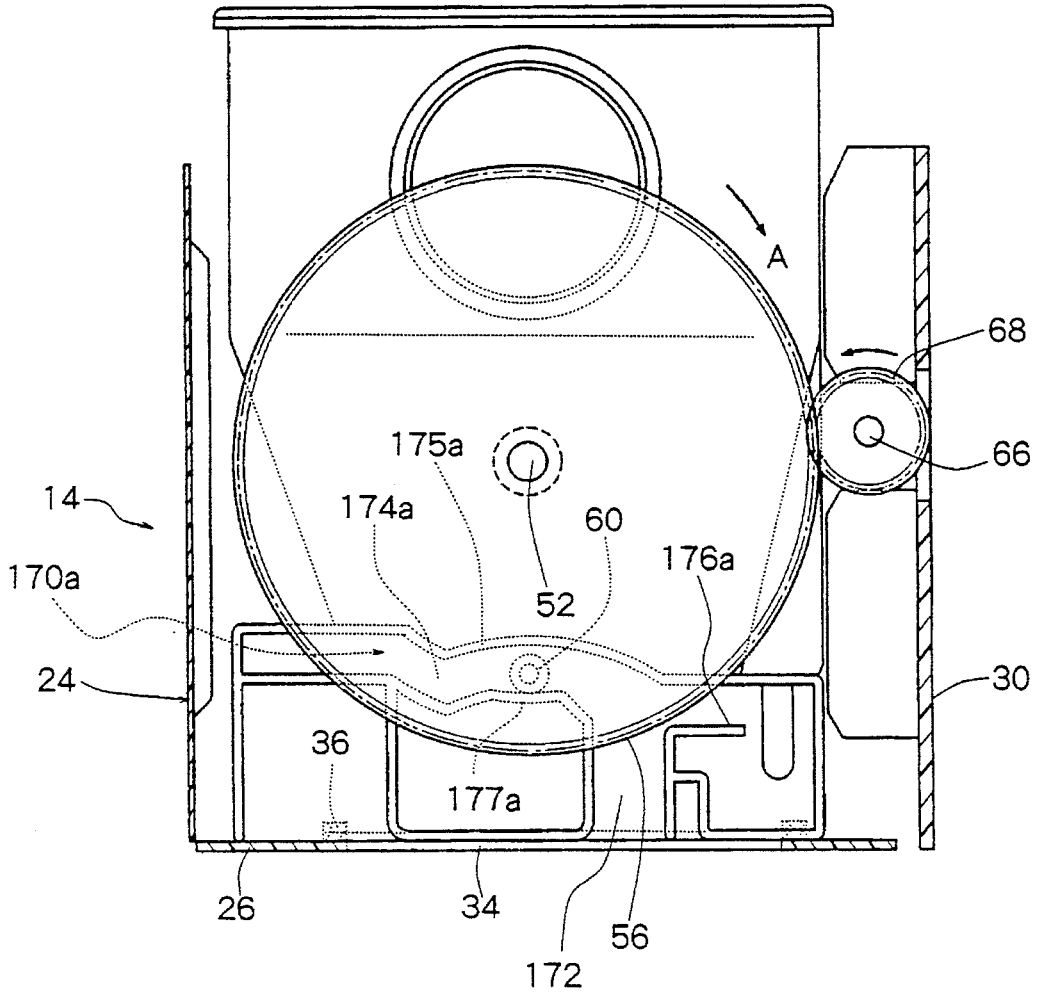
FIG. 12 is an illustration of the hoist means in a state where the toner cartridge inserted in the toner cartridge-holding means is located at a predetermined mounting position in the electrostatic latent image-developing device shown in FIG 1.

The thus constituted toner cartridge 16 is mounted on the toner cartridge-holding means 14. The mounting operation will now be described with reference to FIGS. 10 to 12. First, the toner cartridge 16 is inserted in the toner cartridge-holding means 14 from the upper direction. At the mounting position shown in FIG. 10, the hoist pins 60(62) attached to the hoist gears 56(58) are fitted to the inlet/exit portions 172*a*(172*b*) of the cam grooves 170*a*(170*b*) formed in the base unit 102, and the upper walls 175*a*(175*b*) of the cam grooves 170*a*(170*b*) come into contact with the hoist pins 60(62) to limit the insertion thereof. When the motor M2 is driven in this state, the hoist gears 56(58) are rotated in the direction of arrow A as shown in FIG. 11, and the hoist pins 60 and 62 turn maintaining an engagement with the first lower walls 176*a*(174*b*) of the cam grooves 170*a* and 170*b*, causing the toner cartridge 16 to move downwards. As the hoist gears 56(58) further rotate in the direction of arrow A and the hoist pins 60(62) reach the lowest point, the hoist pins 60(62) pass through the inlet/exit portions 172*a*(172*b*) of the cam grooves 170*a*(170*b*), come into engagement with the second lower walls 177*a*(177*b*) causing the toner cartridge 16 to descend down to the lowest point that is shown in FIG. 11. In this state, the hoist pins 60(62) force the toner cartridge 16 downwards and pushes the bottom wall 106 of the container 100 onto the sealing member 36 arranged on the bottom wall 26 of the toner cartridge-holding means 14. Thus, the toner cartridge 16 is held at the mounting position shown in FIG. 12 very reliably and elastically. In the state where the toner cartridge 16 is mounted on the predetermined position of the toner cartridge-holding means 14, the operation piece 180 is fitted to an open groove 232 of the switch-holding case 220 and acts upon the toner cartridge mount detection switch SW6 to close the circuit.

Figure 14:
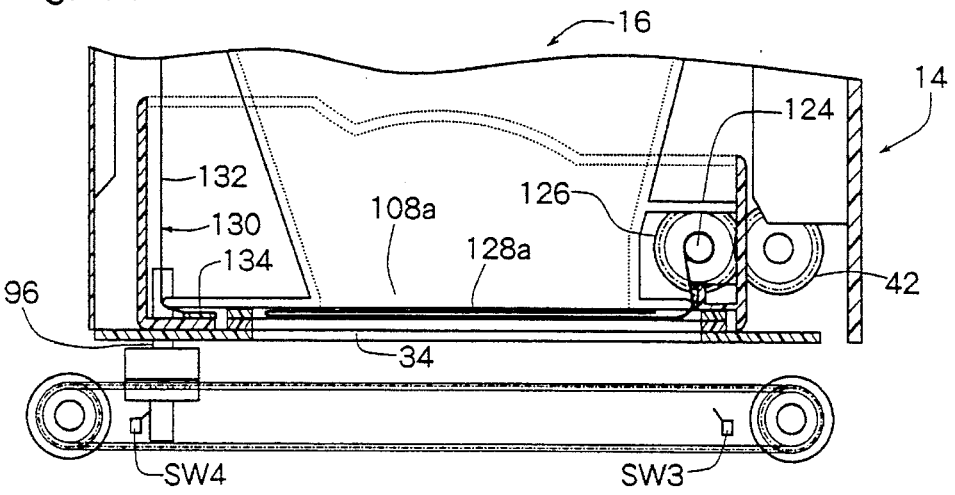
FIG. 14 is an illustration of a sealing tape take-up means in a state where it is not started to take up a sealing tape fitted to the toner cartridge in the electrostatic latent image-developing device shown in FIG. 1.
Figure 15:
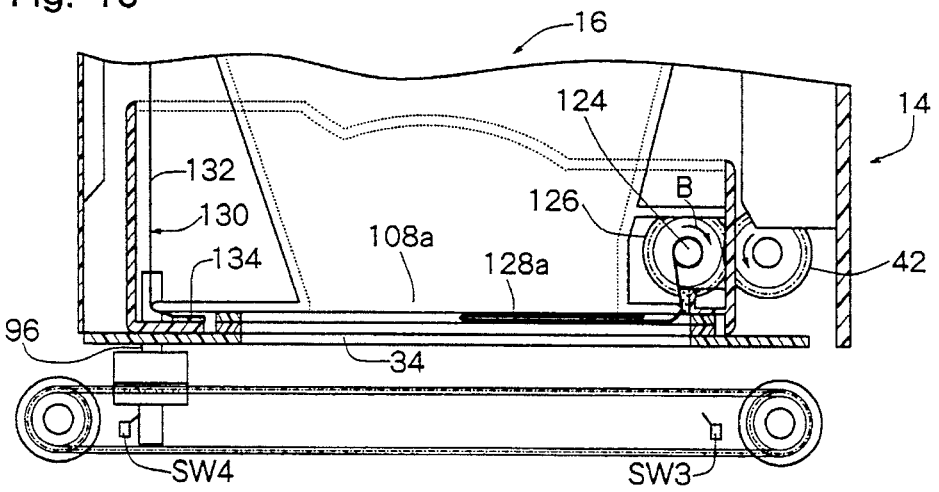
FIG. 15 is an illustration of the sealing tape take-up means in a state where the sealing tape fitted to the toner cartridge is taken up by half of its length in the electrostatic latent image-developing device shown in FIG. 1.
Figure 16:
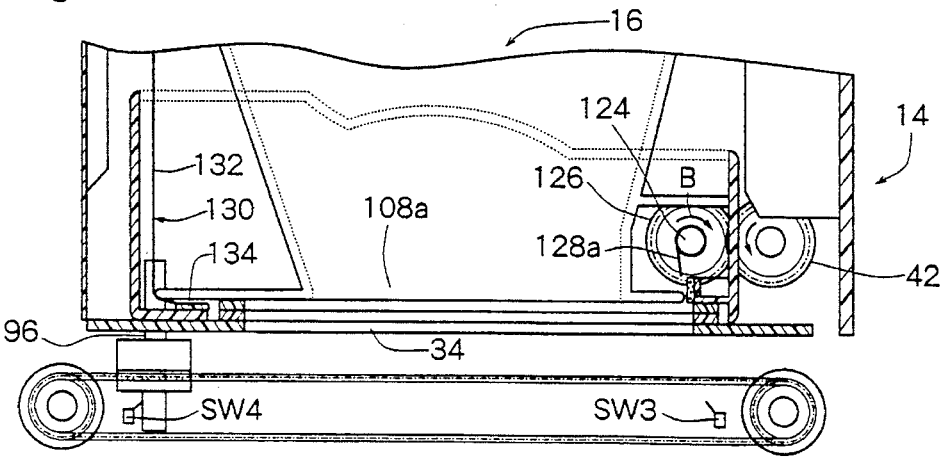
FIG. 16 is an illustration of the sealing tape take-up means in a state where the sealing tape fitted to the toner cartridge is taken up in the electrostatic latent image-developing device shown in FIG. 1.

Described below with reference to FIGS. 14 to 16 is how to take up the sealing tapes 128*a* and 128*b* fitted to the toner cartridge 16 that is mounted on the toner cartridge-holding means 14. In a state where the toner cartridge 16 is mounted on the toner cartridge-holding means 14 as shown in FIG. 14, the gear 126 attached to the take-up shaft 124 is brought into engagement with the gear 42 disposed in the toner cartridge-holding means 14. When the electric motor M1 constituting the sealing tape take-up means is driven in this state, the take-up shaft 124 is rotated via transmission means 43, gear 42 and gear 126, and the sealing tapes 128*a* and 128*b* are taken up. Therefore, the sealing tapes 128*a* and 128*b* are taken up starting from the state where the toner discharge openings 108*a* and 108*b* are covered as shown in FIG. 14 through the state shown in FIG. 15 up to the state where the toner discharge openings 150*a* and 150*b* are fully opened as shown in FIG. 16. As the toner discharge openings 150*a* and 150*b* are opened as described above, the toner T contained in the container 100 is downwardly discharged through the toner discharge openings 150*a*, 150*b* and the toner-receiving opening 34, and is fed into the toner conveying unit 6. Here, the sealing tapes 128*a* and 128*b* taken up by the take-up shaft 124 are accommodated in the closed space 161. When the toner cartridge 16 is taken out from the toner cartridge-holding means 14, therefore, the toner adhered to the sealing tapes 128*a* and 128*b* does not scatter and does not contaminate the surrounding. Moreover, the sealing tapes 128*a* and 128*b* covering the toner discharge openings 108*a* and 108*b* are disposed inside the portion that comes into pressed contact with the sealing member 36, i.e., disposed within the space S. Therefore, the sealing tapes 128*a* and 128*b* do not come into contact with the sealing member 36 during being taken up by the take-up shaft 124. Accordingly, the sealing member 36 is not contaminated with the toner, and elastic property and sealing function are not degraded that would be caused by the toner that has infiltrated into the sealing member 36.

Figure 17:
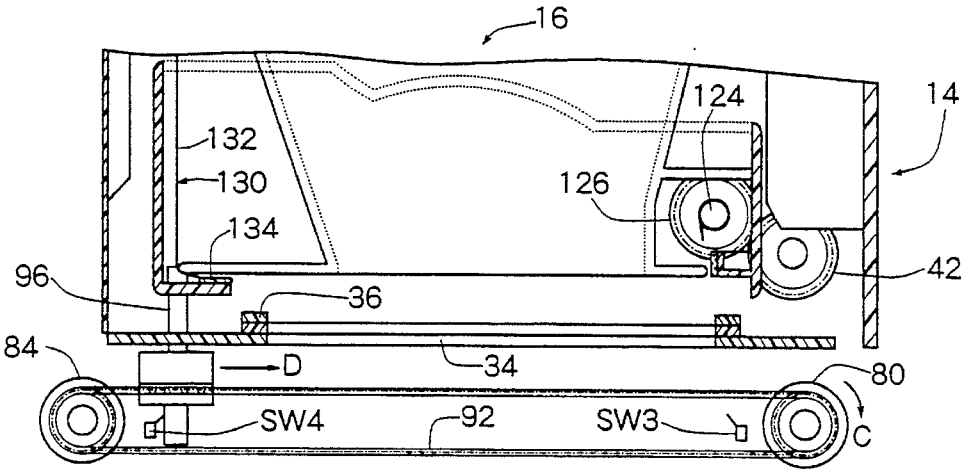
FIG. 17 is an illustration of a state where a shutter member starts moving by a shutter-moving means provided in the electrostatic latent image-developing device shown in FIG. 1.
Figure 18:
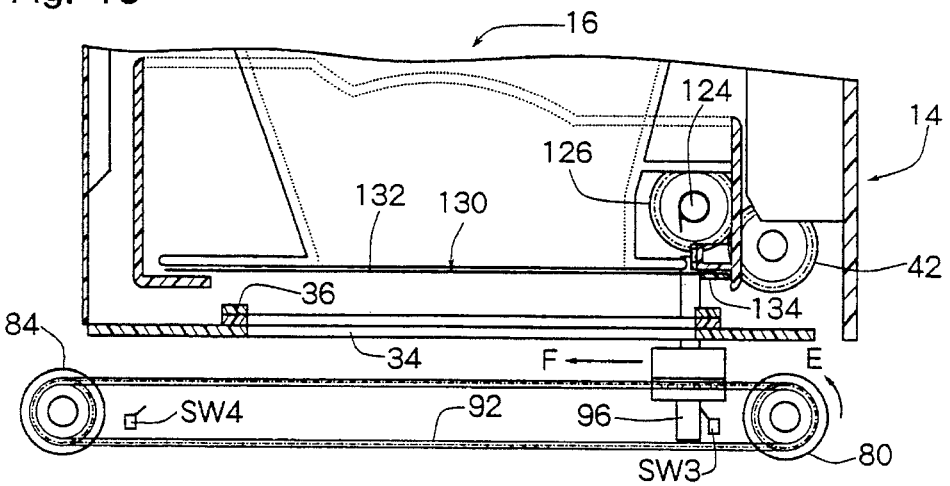
FIG. 18 is an illustration of a state where the shutter member is moved by the shutter-moving means provided in the electrostatic latent image-developing device shown in FIG. 1.
Figure 19:
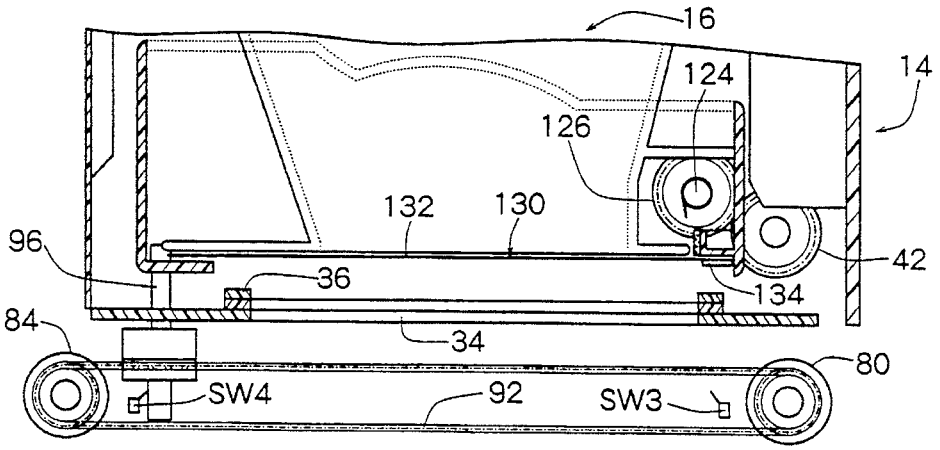
FIG. 19 is an illustration of a state where the shutter member is returned back to the predetermined position by the shutter-moving means provided in the electrostatic latent image-developing means shown in FIG. 1.

Described below with reference to FIGS. 12, 13 and 17 to 19 is the operation for replacing the toner cartridge 16 with a new one after the toner T in the container 100 of the toner cartridge 16 is all consumed. The electric motor M2 is driven starting from the mounting state of FIG. 12, the hoist gears 56(58) are rotated in the direction of arrow A, and the hoist pins 60(62) arrive at a position shown in FIG. 13 that is turned by about 30° from a predetermined mounting position which the lowermost position and, at this moment, the electric motor M2 is stopped. Then, the hoist pins 60(62) come into engagement with the upper walls 175*a* and 175*b* of the cam grooves 170*a* and 170*b*, and cause the toner cartridge 16 to be moved to a position which is elevated by about 5 mm from the mounting position. When the electric motor M3 of the shutter-moving means is driven forward in this state, the pulleys 80(82) are rotated in the direction of arrow C in FIG. 17 via power transmission mechanism 78, gear 76 and drive shaft 74, whereby the timing belts 92(94) are driven in the direction of arrow D. As the timing belts 92(94) are moved in the direction of arrow D, the shutter sliders 96(98) mounted thereon are moved in the direction of arrow D from the positions shown in FIG. 17. Due to this movement, the shutter sliders 96(98) engage with both ends of the engaging members 134 of the shutter member 130, draw out the shutter member 130, and move the engaging member 134 up to predetermined positions on the side of the pulley 80 and on the side of the pulley 84, as shown in FIG. 18. At these positions, both ends of the engaging member 134 come into engagement with engaging pawls 115 and 117 formed at side extended portions 114 and 116 that constitute the lower wall of the container 100. As the shutter member 130 is thus drawn out, the toner discharge openings 150*a* and 150*b* are covered by a shutter sheet 132 of the shutter member 130. Then, the electric motor M3 is driven in the reverse direction to rotate the pulleys 80(82) in the direction of arrow E shown in FIG. 18 and to move the timing belts 92(94) in the direction of arrow F. Accordingly, the shutter sliders 96(98) are returned back to the predetermined positions on the side of the pulleys 84(86) as shown in FIG. 19. In this state, the electric motor M2 is driven to rotate the hoist gears 56(58) in the direction of arrow A. Then, the hoist pins 60(62) rotate upon coming into engagement with the upper walls 175*a*(173*b*) of the cam grooves 170*a*(170*b*), whereby the toner cartridge 16 is moved upwards to establish the state of mounting that is shown in FIG. 10. Thus, the toner cartridge 16 in which the toner has been consumed is pulled up and is easily taken out from the toner cartridge-holding means 14. In the depleted toner cartridge 16 taken out from the toner cartridge-holding means 14, the toner discharge openings 108*a* and 108*b* formed in the lower wall 148 of the container 100 are closed by the shutter member 130 and, hence, the toner T that may have been remaining in small amounts in the container 100 does not scatter around.

The toner conveying unit 6 will now be described with reference to FIGS. 2, 20 and 21. The toner conveying unit 6 that is illustrated is equipped with a housing 300. The housing 300 that can be made of a suitable plastic material has a mounting portion 302 formed in an upper surface at the upstream end thereof so that the toner cartridge-holding means 14 can be mounted thereon, and has a toner delivery opening 304 formed in a lower surface at the downstream end thereof. If described in further detail, on the upper surface at the upstream end (right end portion) of the housing 300 is formed an upstream-side upper wall 306 that extends substantially horizontally. In the upper wall 306 is formed an opening 308 that extends in the direction of width (direction perpendicular to the surface of the paper in FIG. 2). A pair of support walls 310 and 312 are formed, upwardly extending substantially vertically, on both sides of the upper wall 306. The toner cartridge-holding means 14 is mounted on the mounting portion 302 defined by the upper wall 306 and a pair of support walls 310 and 312.

The lower wall of the housing 300 is downwardly tilted in a direction to gradually approach on both sides of the toner delivery opening 304 that is formed in the lower surface at the downstream end of the housing 300 of the toner conveying unit 6, thereby to define a delivery portion 314 of an inverted trapezoidal shape in cross section. A toner delivery means 316 is disposed in the delivery portion 314. The toner delivery means 316 in the illustrated embodiment is constituted by a delivery roller 318 that extends in the direction of width (direction perpendicular to the surface of the paper in FIG. 2). If described with reference to FIGS. 2 and 20, the delivery roller 318 that can be made of a sponge has a rotary shaft 320 that extends in the direction of width substantially horizontally, the rotary shaft 320 being rotatably supported between a front wall 322 and a rear wall 324 of the housing 300. As will be described later, the delivery roller 318 is selectively rotated in a direction indicated by arrow 326, and the toner T is sent to the developing unit 4 through the toner delivery opening 304 in the housing 300.

A toner conveying means which is generally designated at 328 is disposed in the housing 300 of the toner conveying unit 6 to convey the toner T discharged at the upstream end of the housing 300 from the toner cartridge 16 to the toner delivery means 316. The toner conveying means 328 in the illustrated embodiment includes two upstream-side toner conveying means 330 and 332 as well as two downstream-side toner conveying means 334 and 336. In the lower wall of the housing 300 formed are four arcuate portions 338, 340, 342 and 344 that downwardly swell corresponding to the upstream-side toner conveying means 330, 332 and the downstream-side toner conveying means 334, 336. If further described with reference to FIGS. 2 and 20, the upstream-side toner conveying means 330, 332 and the downstream-side toner conveying means 334, 336 include rotary shaft members 346, 348, 350 and 352 that are rotatably supported between the front wall 322 and the rear wall 324 of the housing 300. Rotary members 354, 356, 358 and 360 are fixed to the rotary shaft members 346, 348, 350 and 352 that extend substantially horizontally. Referring to FIG. 20, the rotary member 360 has coupling portions 362 that extend in the radial direction from both ends of the rotary shaft member 352 and a conveying rod 364 that extends between the coupling portions 362 substantially in parallel with the rotary shaft member 352 (i.e., extends substantially horizontally). Similarly, other rotary members 354, 356 and 358 have coupling portions extending in the radial direction from both ends of the rotary shaft members 346, 348 and 350 and conveying rods that extend between the coupling portions substantially in parallel with the rotary shaft members 346, 348 and 350. The rotary members 354, 356, 358 and 360 are disposed with their phases deviated from each other as shown in the FIG. 2. As will be described later, the upstream-side toner conveying means 330, 332 and the downstream-side toner conveying means 334, 336 are selectively rotated in the direction indicated by arrow 366. The conveying rods of the rotary members 354, 356, 358 and 360 are moved along the arcuate portions 338, 340, 342 and 344 in the lower wall of the housing 300 to move the toner T in the housing 300 from the right toward the left in FIG. 2. The downstream-side toner conveying means 336 is further provided with an auxiliary rotary member 368. The auxiliary rotary member 368 has coupling portions 370 that extend in the radial direction from the rotary shaft member 352 on the inside of the coupling portions 362 of the rotary member 360 in the direction of width (axial direction), and an auxiliary rod 372 that extends between the coupling portions 370 in parallel with the conveying rod 364 of the rotary member 360 on the inside in the radial direction thereof. As will be clearly understood from FIG. 2, the auxiliary rotary member 368 is fixed to the common rotary shaft member 352 being displaced by a predetermined angle which may be about 50 degrees in the direction of rotation indicated by arrow 366 with respect to the rotary member 360. Therefore, the auxiliary rotary member 368 is rotated together with the rotary member 360 in the direction indicated by arrow 366.

Figure 20:
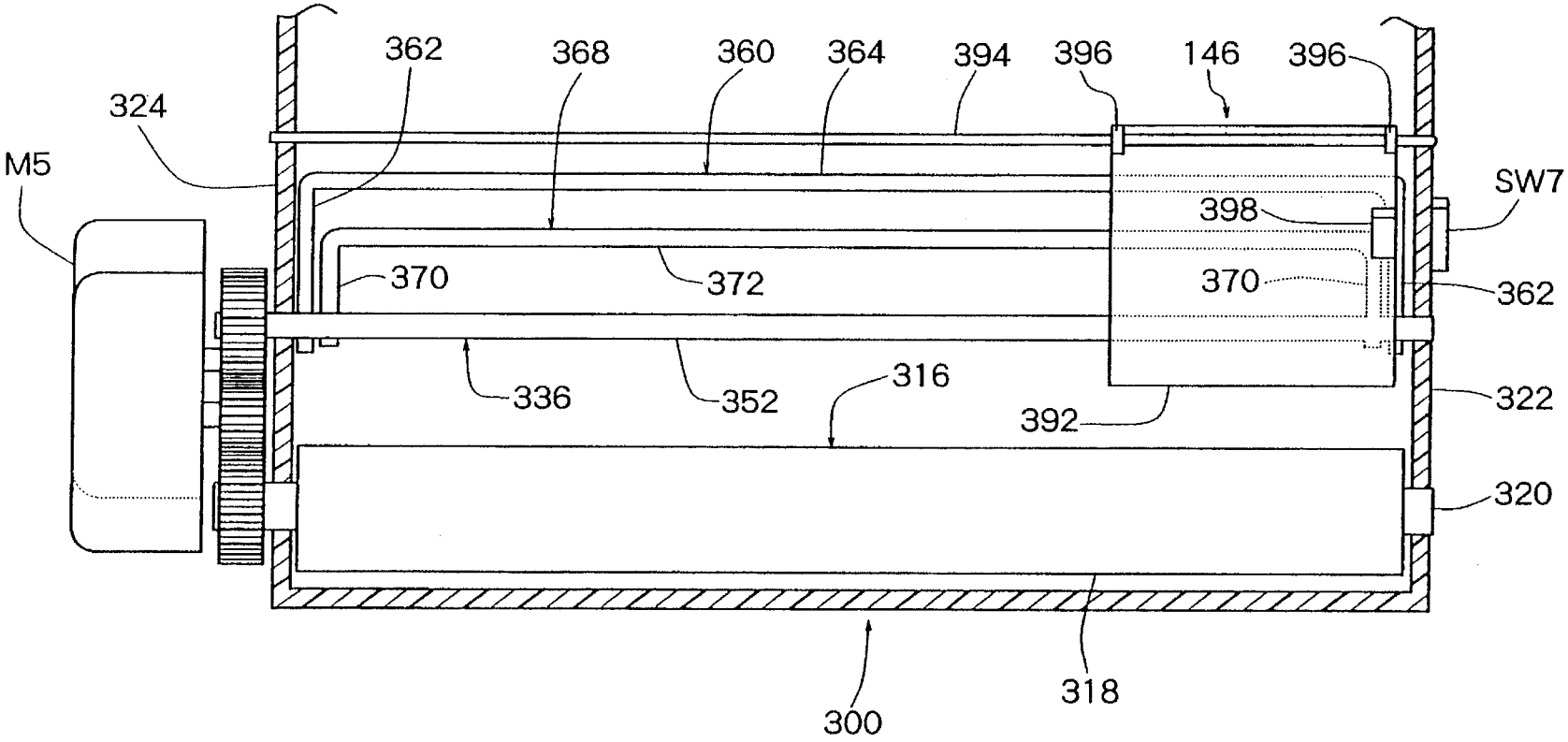
FIG. 20 is a sectional view illustrating a portion of the toner conveying unit in the electrostatic latent image-developing device shown in FIG. 1.
Figure 21:
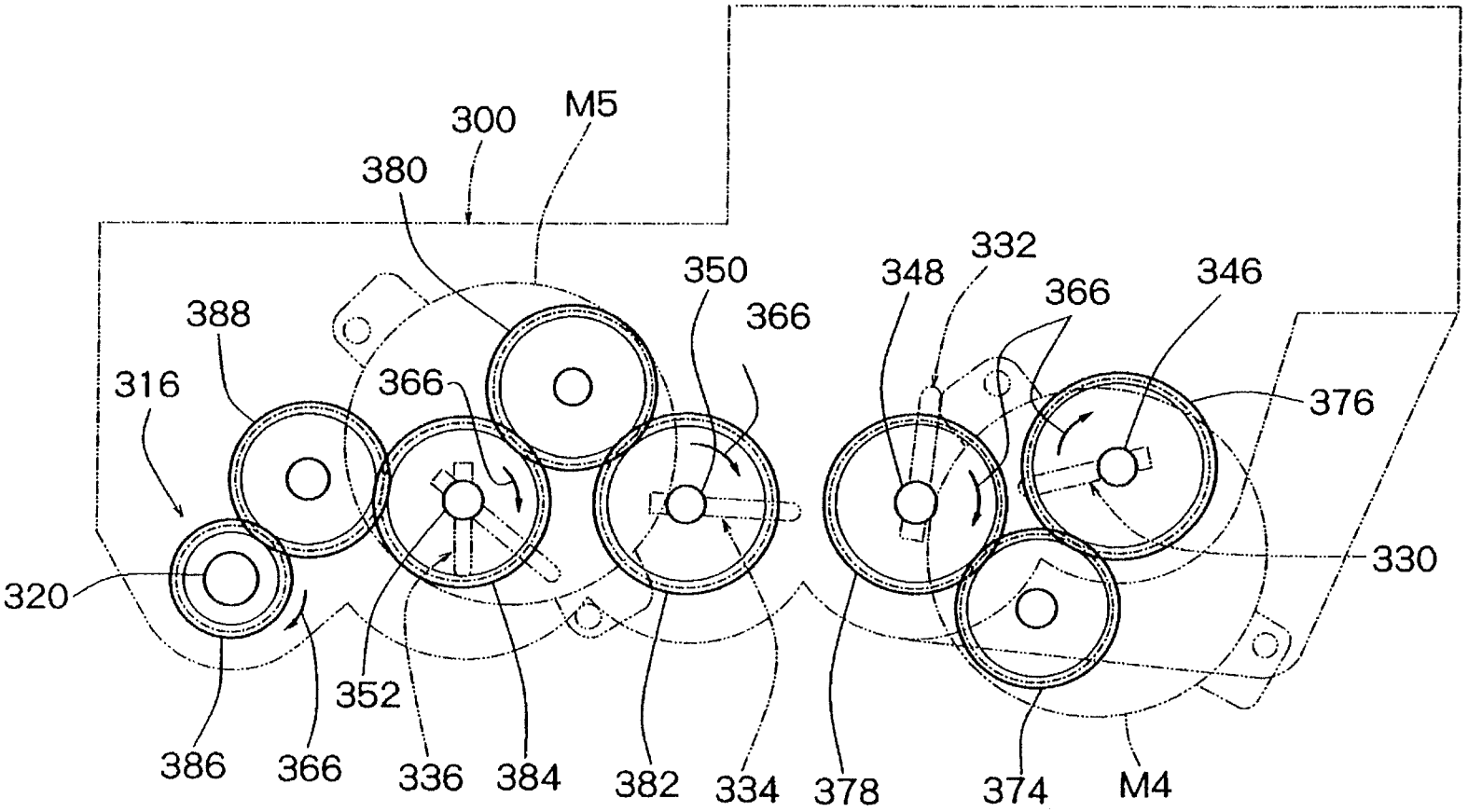
FIG. 21 is a schematical view illustrating a drive sequence of the toner conveying unit in the electrostatic latent image-developing device shown in FIG. 1.

With reference to FIGS. 2, 20 and 21, on the outer surface (back side) of the rear wall 324 of the housing 300 are disposed two drive means, i.e., an electric motor M4 that constitutes the upstream-side drive means and an electric motor M5 that constitutes the downstream-side drive means. An output gear 374 is attached to the output shaft of the electric motor M4. Rotary shaft members 346 and 348 of the upstream-side toner conveying means 330 and 332 rearwardly protrude penetrating through the rear wall 324, and input gears 376 and 378 are secured to the protruded ends thereof. As clearly shown in FIG. 21, the output gear 374 is engaged with the input gears 376 and 378. When the electric motor M4 is energized, the upstream-side toner conveying means 330 and 332 are rotated in a direction indicated by arrow 366. Similarly, an output gear 380 is attached to the output shaft of the electric motor M5. The rotary shaft members 350 and 352 of the downstream-side toner conveying means 334 and 336 are rearwardly protruded penetrating through the rear wall 324, and input gears 382 and 384 are secured to the protruded ends. Further, the rotary shaft 320 of the toner delivery means 316 rearwardly protrudes penetrating through the rear wall 324, and an input gear 386 is attached to the protruded end thereof. The output gear 380 of the electric motor M5 constituting the downstream-side drive means is engaged with the input gears 382 and 384. Besides, the input gear 384 is engaged with the input gear 386 via a transmission gear 388. Then, as the electric motor M5 is energized, the downstream-side toner conveying means 334 and 336 are rotated in the direction indicated by arrow 366, and the toner delivery means 316 is rotated, too, in the direction indicated by arrow 366.

As shown in FIGS. 2 and 20, the toner conveying unit 6 is further provided with a toner amount detection means 390 for detecting the amount of the toner present in the downstream portion of the housing 300. The toner amount detection means 390 in the illustrated embodiment includes a swing plate 392. A support shaft 394 is fitted between the front wall 322 and the rear wall 324 of the housing 300. Upright mounting pieces 396 are formed on both sides of the base end of the swing plate 392 as a unitary structure, and a support shaft 394 is inserted in the mounting pieces 396, so that the swing plate 392 is swingably fitted at the front end of the support shaft 394. A permanent magnet 398 is attached to the front end of the swing plate 392 (portion adjacent to the front wall of the housing 300). Furthermore, a reed switch SW7 is fastened to a predetermined position on the outer surface (front surface) of the front wall 322 of the housing 300 to constitute a detector that detects the permanent magnet 398 of the swing plate 392.

When the toner T is present in sufficient amounts in the downstream portion of the housing 300 as shown in FIG. 2, the free end of the swing plate 392 comes into contact with the upper surface of the toner T; i.e., the swing plate 392 is maintained at a relatively high position, and the reed switch SW7 never detects the permanent magnet 398. As the amount of the toner T decreases in the downstream portion of the housing 300, the swing plate 392 turns in the counterclockwise direction in response thereto, and the reed switch SW7 detects the permanent magnet 398. The swing plate 392 descends with the decrease in the amount of the toner T in the downstream portion of the housing 300, and then protrudes into the loci of revolution of the conveying rod 364 of the rotary member 360 and of the auxiliary rod 372 of the auxiliary rotary member 368 in the downstream-side toner conveying means 336. Therefore, as the downstream-side toner conveying means 336 is rotated in the direction indicated by arrow 366, the auxiliary rod 372 of the auxiliary rotary member 368, first, acts on the swing plate 392 to turn it in the counterclockwise direction so that it is raised and then, the conveying rod 368 of the rotary member 360 acts on the swing plate 392 to further turn it in the counterclockwise direction so that it is raised. Then, when the rotary member 360 no longer acts thereupon, the swing plate 392 turns in the clockwise direction due to its own weight and is lowered down to a illustrated position, i.e., to a position where the reed switch SW7 detects the permanent magnet 398. Therefore, as the amount of the toner T becomes smaller than a predetermined value in the downstream portion of the housing 300, the reed switch SW7 periodically detects the permanent magnet 398 while the downstream-side toner conveying means 336 is rotated in the direction indicated by arrow 366. In response to the operation of the downstream-side toner conveying means 336, the swing plate 392 reciprocatingly swings in the counterclockwise direction and in the clockwise direction, preventing very reliably the defective swing of the swing plate 392 that may result, for example, from the blocking of the toner T between the mounting piece 396 of the swing plate 392 and the support shaft 394. Even when the toner T exists in sufficient amounts in the downstream portion of the housing 300, the upper surface of the toner T periodically moves up and down to some extent as the downstream-side toner conveying means 336 is rotated in the direction indicated by arrow 366. Therefore, the swing plate 392 reciprocatingly swings to some extent, and is reliably prevented from occurrence of incomplete swinging.

The developing unit 4 shown in FIG. 2 is equipped with a developing housing 402. The developing housing 402 has a developing opening 404 formed in the left side surface thereof and a toner-receiving opening 406 formed at a right end in the upper surface thereof. In the developing housing 402 are disposed a magnetic brush mechanism 408 and stirrer mechanisms 410 and 412. The developing housing 402 contains a developing agent 414 which comprises a toner and carriers. The stirrer mechanisms 410 and 412 constituted by rotary stirrer members that are rotated in the directions indicated by arrows 416 and 418, work to stir the developing agent 414 in the developing housing 402 to frictionally charge the toner into a predetermined polarity. The magnetic brush mechanism 408 is constituted by a sleeve member 420 that is rotated in a direction indicated by arrow 418 and a stationary permanent magnet 422 disposed in the sleeve member 420. The developing agent 414 is magnetically held on the peripheral surface of the sleeve member 420 and is conveyed to a developing zone 424 where the toner is applied to electrostatic latent image formed on a photosensitive material that is disposed on the peripheral surface of the rotary drum 12. The toner in the developing agent 414 is consumed as the developing is executed, and the toner is supplied into the developing housing 402 from the toner conveying unit 6 as the toner is consumed. In order to detect the amount of consumption of toner in the developing agent 414, the toner concentration detection means 430 is disposed on the developing housing 402 near the magnetic brush mechanism 408. The toner concentration detection means 430 can be constituted by a widely known permeability sensor. By measuring the magnetic permeability of the developing agent 414 in the developing housing 402, the toner concentration in the developing agent 414 is detected, and the detection signal is sent to a control means that will be described later.

Figure 22:
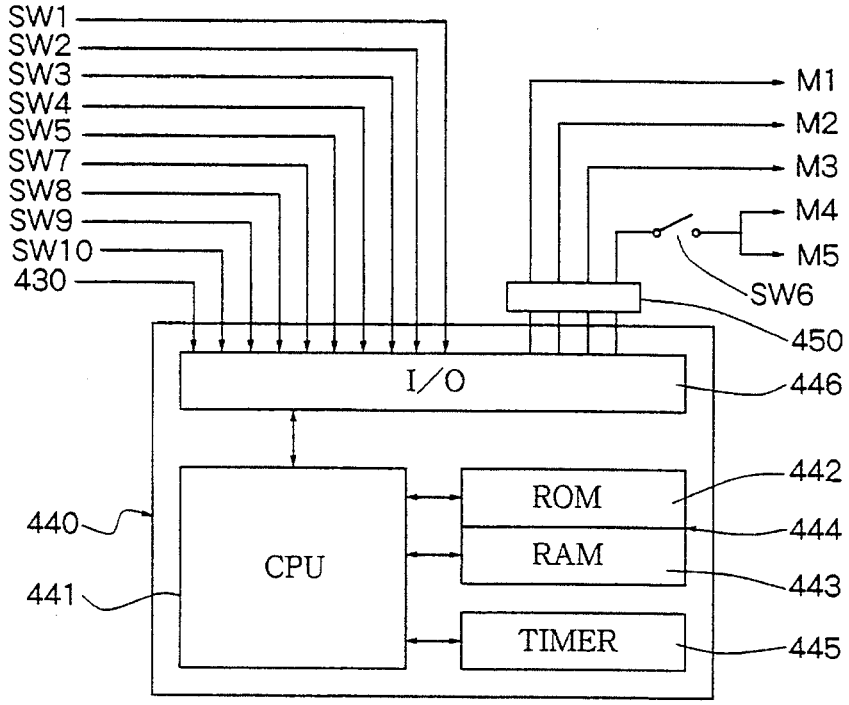
FIG. 22 is a block diagram which schematically illustrates the constitution of an embodiment of a control means which controls the operation of the electrostatic latent image-developing device shown in FIG 1.
Figure 23:
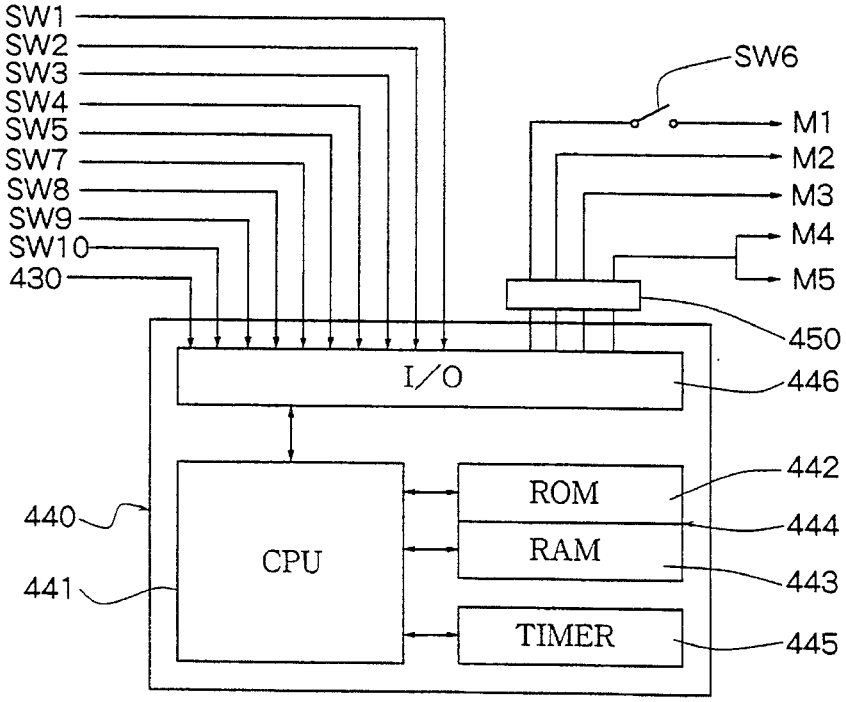
FIG. 23 is a block diagram which schematically illustrates the constitution of another embodiment of the control means which controls the operation of the electrostatic latent image-developing device shown in FIG. 1.

The electrostatic latent image-developing device according to the illustrated embodiment is equipped with a control means 440 that is shown in FIG. 22 to control the operations of an electric motor M1 that constitutes the sealing tape take-up means, an electric motor M2 that constitutes the hoist means, an electric motor M3 that constitutes the shutter-moving means, an electric motor M4 that constitutes the upstream-side drive means and an electric motor M5 that constitutes the downstream-side drive means. The control means 440 is constituted by a microcomputer equipped with a central processing unit 441 that executes the processing according to a control program, a storage means 444 having a ROM 442 for storing a control program and a control map and a RAM 443 for storing the operated results, a timer 445, and an input/output interface 446. The control means 440 receives signals from the hoist pin position detection switches SW1 and SW2, first and second slider position detection switches SW3 and SW4, toner cartridge detection switch SW5, reed switch SW7, toner concentration detection means 430, toner cartridge mount switch SW8 which is an instruction means disposed on an operation board that is not shown, toner cartridge take-out switch SW9, copy switch SWlO and like switches, and sends to a drive circuit 450 the control signals for controlling the operations of the electric motors M1, M2, M3, M4 and M5. The drive circuit 450 supplies electric power to the electric motors M1, M2, M3, M4 and M5 based upon the control signals from the control means 440. In the embodiment shown in FIG. 22, the toner cartridge mount detection switch SW6 is inserted in an electric circuit that supplies electric power from the drive circuit 450 to the electric motors M4 and M5. In an embodiment shown in FIG. 23, the toner cartridge mount detection switch SW6 is inserted in an electric circuit that supplies electric power from the drive circuit 450 to the electric motor M1.

Figure 24:
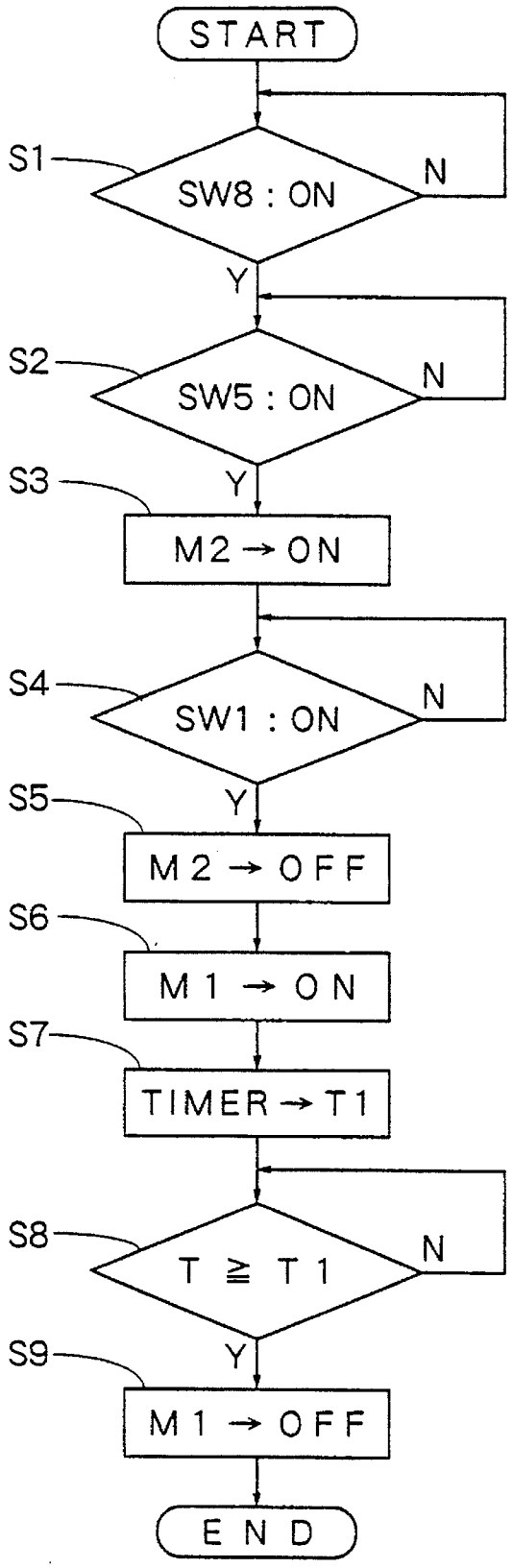
FIG. 24 is a flow chart for explaining the operation for mounting the toner cartridge by the control means shown in FIGS. 22 and 23.

Operation of the electrostatic latent image-developing device controlled by the above-mentioned control means 440 will now be described with reference also to a flow chart of FIG. 24.

The toner cartridge 16 can be mounted in the toner cartridge-holding means 14 in a manner as described below. First, the toner cartridge 16 is inserted in the toner cartridge-holding means 14 from the upper direction to be in a state as shown in FIG. 10. The operator, then, turns the toner cartridge mount switch SW8 on, so that the control means 440 starts operating. Referring to FIG. 24, the control means 440 checks whether the toner cartridge mount switch SW8 is turned on or not (step S1). When the toner cartridge mount switch SW8 is turned on, the control means 440 makes sure whether the toner cartridge detection switch SW5 is turned on or not (step S2). This is to prevent the electric motor M2 of the hoist means from operating in a state where no toner cartridge 16 is inserted in the toner cartridge-holding means 14. When the toner cartridge detection switch SW5 is on in the step S2, it means that the toner cartridge 16 has been inserted in the toner cartridge-holding means 14. The control means 440 drives the electric motor M2 of the hoist means at a step S3. As the electric motor M2 is driven, the hoist pins 60(62) rotate upon engagement with the first and second lower walls 176*a*(176*b*) and 177*a*(177*b*) of the cam grooves 170*a*(170*b*), causing the toner cartridge 16 to move downwards. As the hoist pins 60(62) arrive at the lowest position, the hoist pin position detection switch SW1 is turned on, and the control means 440 checks whether the hoist pin position detection switch SW1 is turned on or not (step S4). When the hoist pin position detection switch SW1 is not turned on, the electric motor M2 of the hoist means is continuously driven. When the hoist pin position detection switch SW1 is turned on, it means that the toner cartridge 16 is brought to the predetermined mounting position, and the electric motor M2 of the hoist means is no longer driven (step S5). When the toner cartridge 16 is brought to the predetermined mounting position, the control means 440 drives the electric motor M1 that constitutes the sealing tape take-up means (step S6) and sets a timer 185 to T1 (step S7). With the electric motor M1 being driven, the take-up shaft 124 is rotated via transmission means 43, gear 42 and gear 126, and the sealing tapes 128*a* and 128*b* are taken up. After the electric motor M1 is driven, the control means 440 checks whether the time T passed from the start of the driving has reached the above-set time T1 or not (step S8). When the time T has not reached the set time T1, the electric motor M1 is continuously driven and when the time T has reached the set time T1, the electric motor M1 is stopped (step S9). Therefore, the time T1 has been so set as will be long enough for taking up the sealing tapes 128*a* and 128*b*. When the sealing tapes 128*a*(128*b*) are completely taken up by the take-up shaft 124 as shown in FIG. 16 and the toner discharge openings 108*a*(108*b*) are opened, the toner T contained in the container 100 is downwardly discharged through the toner discharge openings 150*a*(150*b*) and the toner-receiving opening 34, and is fed into the toner conveying unit 6. In the embodiment shown in FIG. 23, when the toner cartridge 16 is brought to the predetermined mounting position and the toner cartridge-holding means 14 and the region where the toner cartridge 16 will be used are in agreement, the toner cartridge mount detection switch SW6 is closed by the operation piece 180 as described above, and the electric power is supplied to the electric motor M1 based upon a control signal from the control device 440 to drive it. When the toner cartridge-holding means 14 and the region where the toner cartridge 16 will be used are not in agreement, however, the toner cartridge mount detection switch SW6 and the operation piece 180 do not correspond to each other, and the toner cartridge mount detection switch SW6 is not closed by the operation piece 180 despite the toner cartridge 16 is brought to the predetermined mounting position of the toner cartridge-holding means 14. Accordingly, the supply of electric power to the electric motor M1 is interrupted and the electric motor M1 is not driven despite the control signal is output from the control device 440 to the drive circuit 450; i.e., the sealing tapes 128*a*(128*b*) are not taken up. This indicates that the toner cartridge be replaced by a proper one.

Figure 25:
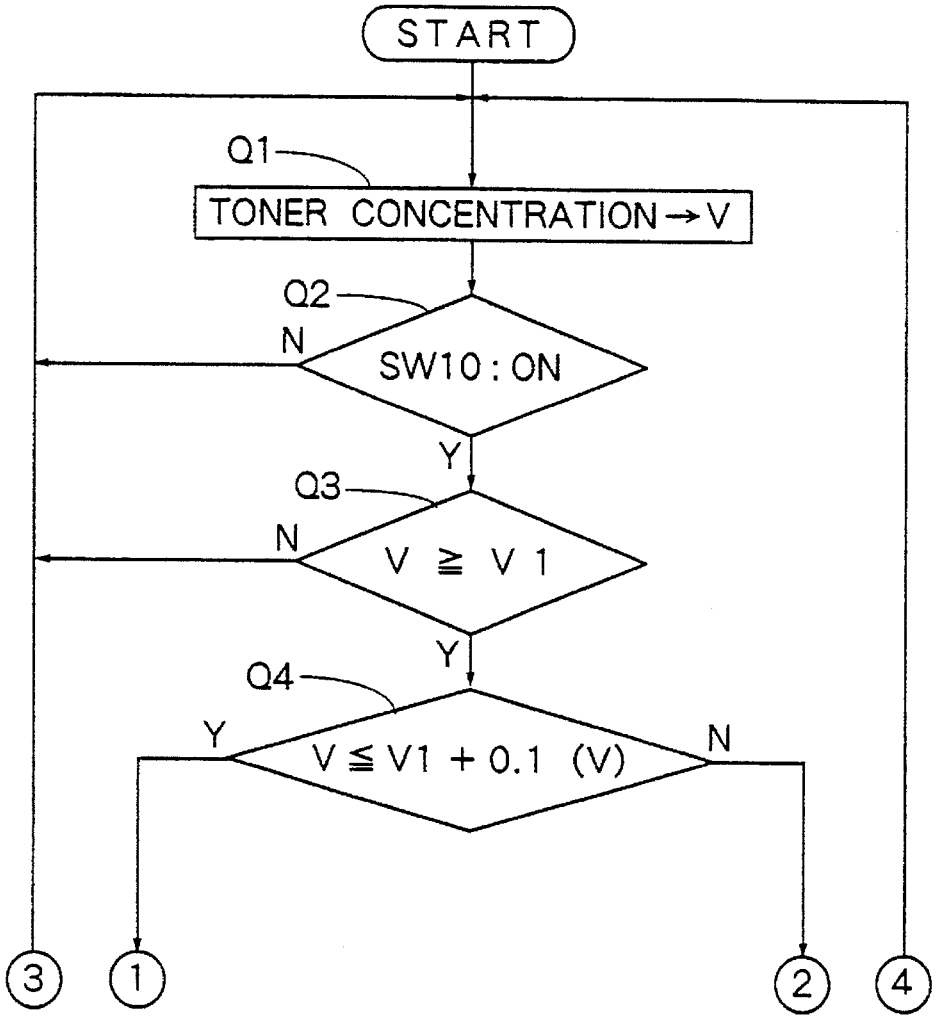
FIG. 25 is a flow chart explaining the operation for controlling a conveyer means and a toner solidification-preventing means by the control means shown in FIGS. 22 and 23.
Figure 26:
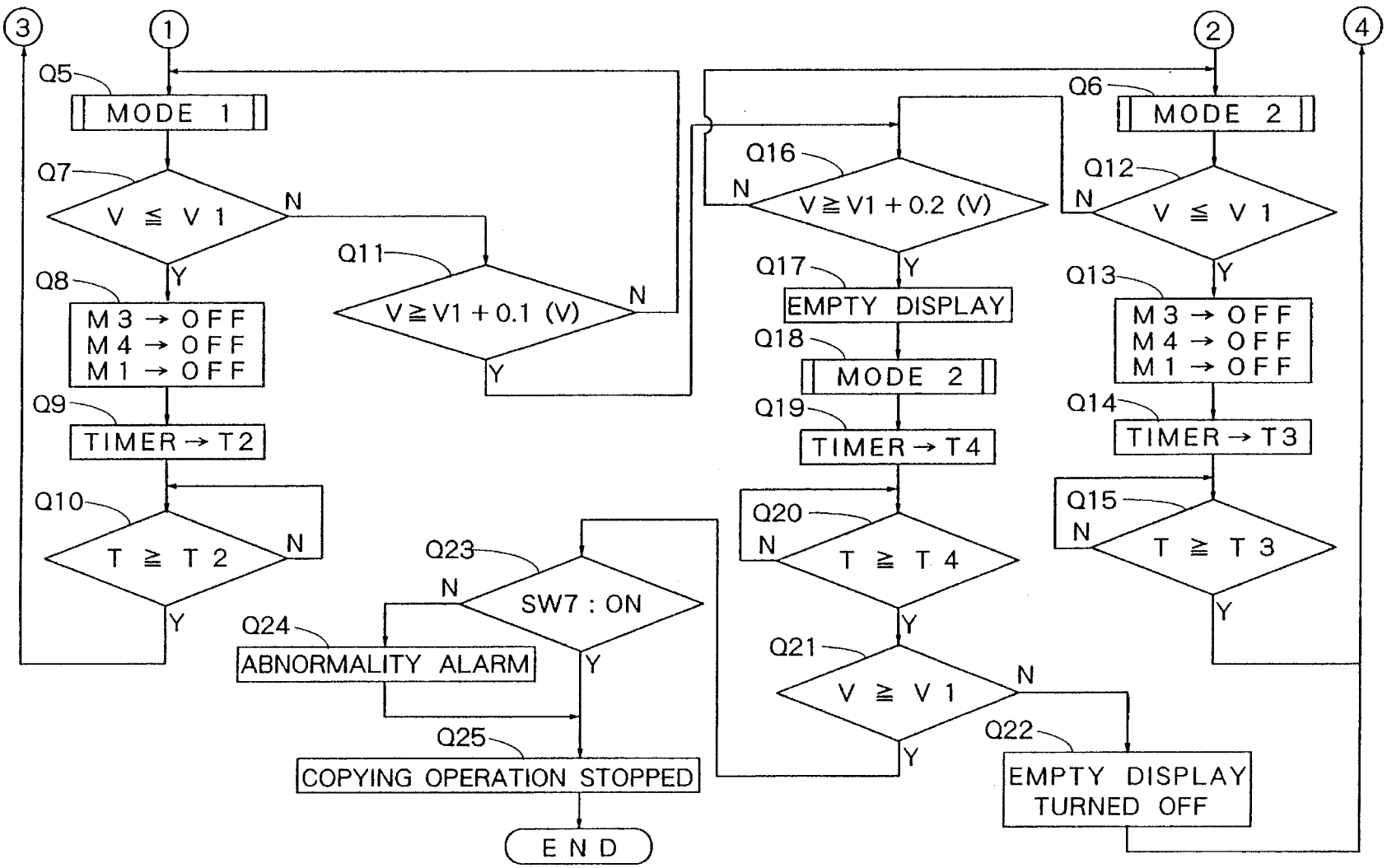
FIG. 26 is a flow chart explaining the operation for controlling the conveying means and the toner solidification-preventing means by the control means shown in FIGS. 22 and 23.

In an image-forming machine equipped with the electrostatic latent image-developing device in which the toner cartridge 16 is mounted on the toner cartridge-holding means 14 as described above, the electric motor M1, the electric motor M4 constituting the upstream-side drive means and the electric motor M5 constituting the downstream-side drive means are controlled for their operations as shown in the flow charts of FIGS. 25 and 26. That is, the control means 440 receives a signal (output voltage) from the toner concentration detection means 430, detects a toner concentration V in the developing agent 414, and stores it in the RAM 443 (step Q1). According to this embodiment, the toner concentration detection means 430 produces an output voltage that increases with a decrease in the toner concentration. The toner concentration V is obtained by, for example, reading a signal from the toner concentration detection means 430 twelve times for every 16 milliseconds, and an average value thereof is stored as one time of detection data in the RAM 443. The toner concentration V is periodically detected, and the detection data stored in the RAM 443 is renewed at all times. The control means 440 checks at a step Q2 whether the copy switch SW10 for instructing the copying operation is turned on or not (step Q2). When the copy switch SW10 is turned on, the program proceeds to a step Q3 where the latest data related to the toner concentration V stored in the RAM 443 is compared with a control level voltage V1 for the toner concentration. When the toner concentration V in the developing agent 414 is lower than the control level voltage V1 (when the toner concentration is more dense than the control level), the program returns back to the step Q2 and when the toner concentration V in the developing agent 414 is higher than the control level voltage V1, the program proceeds to a step Q4 where it is judged whether the toner concentration V is not larger than the control level voltage V1 plus 0.1 volt. When the toner concentration V of the developing agent 414 is not larger than the control level voltage V1 plus 0.1 volt, the program proceeds to a step Q5 where the control operation of mode 1 is executed. When the toner concentration V is larger than the control level voltage V1 plus 0.1 volt, the program proceeds to a step Q6 where the control operation of mode 2 is executed. When the mode 1 is selected and the program proceeds to the step Q5, the electric motor M3 constituting the upstream-side drive means and the electric motor M4 constituting the downstream-side drive means are controlled, and the electric motor M1 is controlled to rotate the take-up shaft 124, whereby the toner solidification-preventing means 200 drivably coupled to the take-up shaft 124 is actuated to replenish the toner. Replenishment of the toner is controlled by, for example, repeating a cycle in which the electric motors M3, M4 and M1 are driven (turned on) for 1.5 seconds and are stopped (turned off) for 1.0 second. In controlling the toner replenishment, the control means 440 compares the latest data related to the toner concentration V with the control level voltage V1 for the toner concentration (step Q7). When the toner concentration V is smaller than the control level voltage V1, the program proceeds to a step Q8 where the electric motors M3, M4 and M1 are stopped (turned off) and the timer 445 is set to T2 (e.g., 1.0 second)(step Q9). After the timer 445 is set to T2, the control means 440 checks whether the passage of time T after the above motors are stopped has reached T2 or not (step Q10). When the passage of time T has not reached T2, T2 is waited for. When the passage of time T has reached T2, the program returns back to the step Q1. When the toner concentration V is larger than the control level voltage V1 in the step Q7, the program proceeds to a step Q11 where the control means 440 checks whether the toner concentration V is larger than the control level voltage V1 plus 0.1 volt or not. When the toner concentration V is smaller than the control level voltage V1 plus 0.1 volt, the program returns back to the step Q5 where the control operation of the mode 1 is continued. When the toner concentration V is larger than the control level voltage V1 plus 0.1 volt in the step Q11, the control means 440 executes the operations of the step Q16 and the subsequent steps. When the toner concentration V is larger than the control level voltage V1 plus 0.1 volt in the step Q4 and the program proceeds to the step Q6 to select the mode 2, the electric motors M3, M4 and M1 are controlled to control the operation for replenishing the toner. The replenishment of the toner is controlled by, for example, repeating a cycle in which the electric motors M3, M4 and M1 are driven (turned on) for 1.5 seconds and are stopped (turned off) for 0.5 seconds. In controlling the toner replenishment, the control means 440 compares the latest data related to the toner concentration V with the control level voltage V1 for the toner concentration (step Q12). When the toner concentration V is smaller than the control level voltage V1, the program proceeds to a step Q13 where the electric motors M3, M4 and M1 are stopped (turned off) and the timer 445 is set to T3 (e.g., 0.5 seconds) (step Q14). After the timer 445 is set to T3, the control means 440 checks whether the passage of time T after the above motors are stopped has reached T3 or not (step Q15). When the passage of time T has not reached T3, T3 is waited for. When the passage of time T has reached T3, the program returns back to the step Q2. When the toner concentration V is larger than the control level voltage V1 in the step Q12, the program proceeds to a step Q16 where the control means 440 checks whether the toner concentration V is of an empty concentration which is larger than the control level voltage V1 plus 0.2 volts. When the toner concentration V is lower than the control level voltage V1 plus 0.2 volts, the program returns back to the step Q6 where the control operation of the mode 2 is continued. When the toner concentration V is larger than the control level voltage V1 plus 0.2 volts in the step Q16, the program proceeds to a step Q17 where the control means 440 makes an empty display on an operation board that is not shown (step Q17), controls the operation for replenishing the toner at a step Q18 like in the above-mentioned mode 2, and sets the timer 445 to T4 (e.g., 150 seconds)(step Q19). After the timer 445 is set to T4, the control means at the step Q18 checks whether the passage of time T after the start of the operation for controlling the toner replenishment in the same manner as the above mode 2 has reached T4 or not (step Q20). When T has not reached T4, T4 is waited for. When T has reached T4, the latest data related to the toner concentration V is compared with the control level voltage V1 for the toner concentration (step Q21) in order to check whether the toner concentration V has restored to the control level voltage V1 or not. When the toner concentration V has reached the control level voltage V1, the program proceeds to a step Q22 where the empty display is turned off and the program returns back to the step Q1. When the toner concentration V has not reached the control level voltage V1 at the step Q21, the control means 440 checks whether the reed switch SW7 of the toner amount detection means 390 is turned on or not in order to make sure whether the toner in the toner cartridge 16 is all consumed or not (step Q23). When the reed switch SW7 is not turned on at the step Q23, no toner has been supplied to the developing unit 4 despite the toner is existing in amounts greater than a predetermined value in the toner conveying unit 6 or an abnormal condition is occurring in which the toner has been consumed in an abnormally large amount in the developing unit 4. Therefore, the program proceeds to a step Q24 where the control means 440 produces an abnormality alarm on the operation board that is not shown, and the copying operation is stopped at a step Q25. When the reed switch SW7 has been turned on, it is so judged that the toner in the toner cartridge 16 is consumed and the program proceeds to the step Q25 to stop the copying operation.

Figure 13:
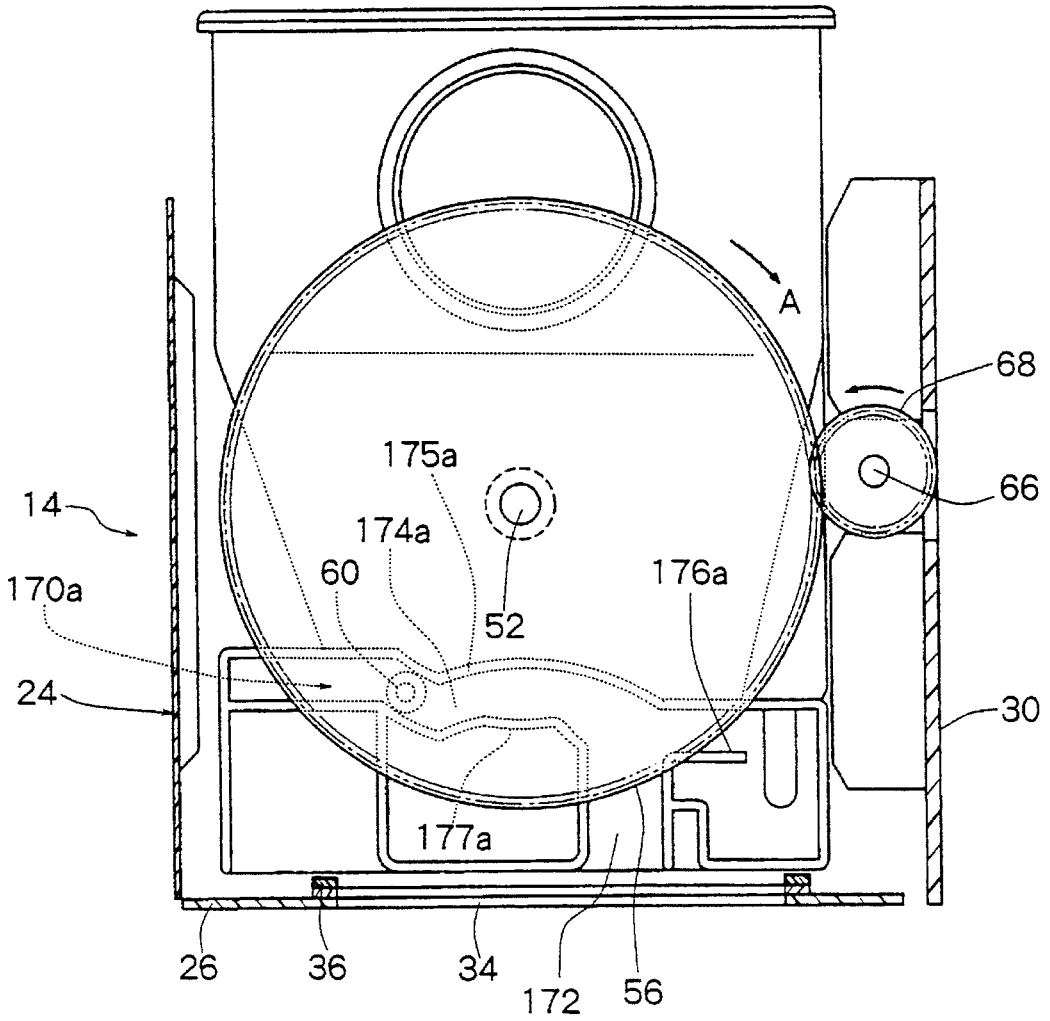
FIG. 13 is an illustration of the hoist means in a state where the toner cartridge inserted in the toner cartridge-holding means is located at a position slightly elevated from the predetermined mounting position in the electrostatic latent image-developing device shown in FIG. 1.
Figure 27:
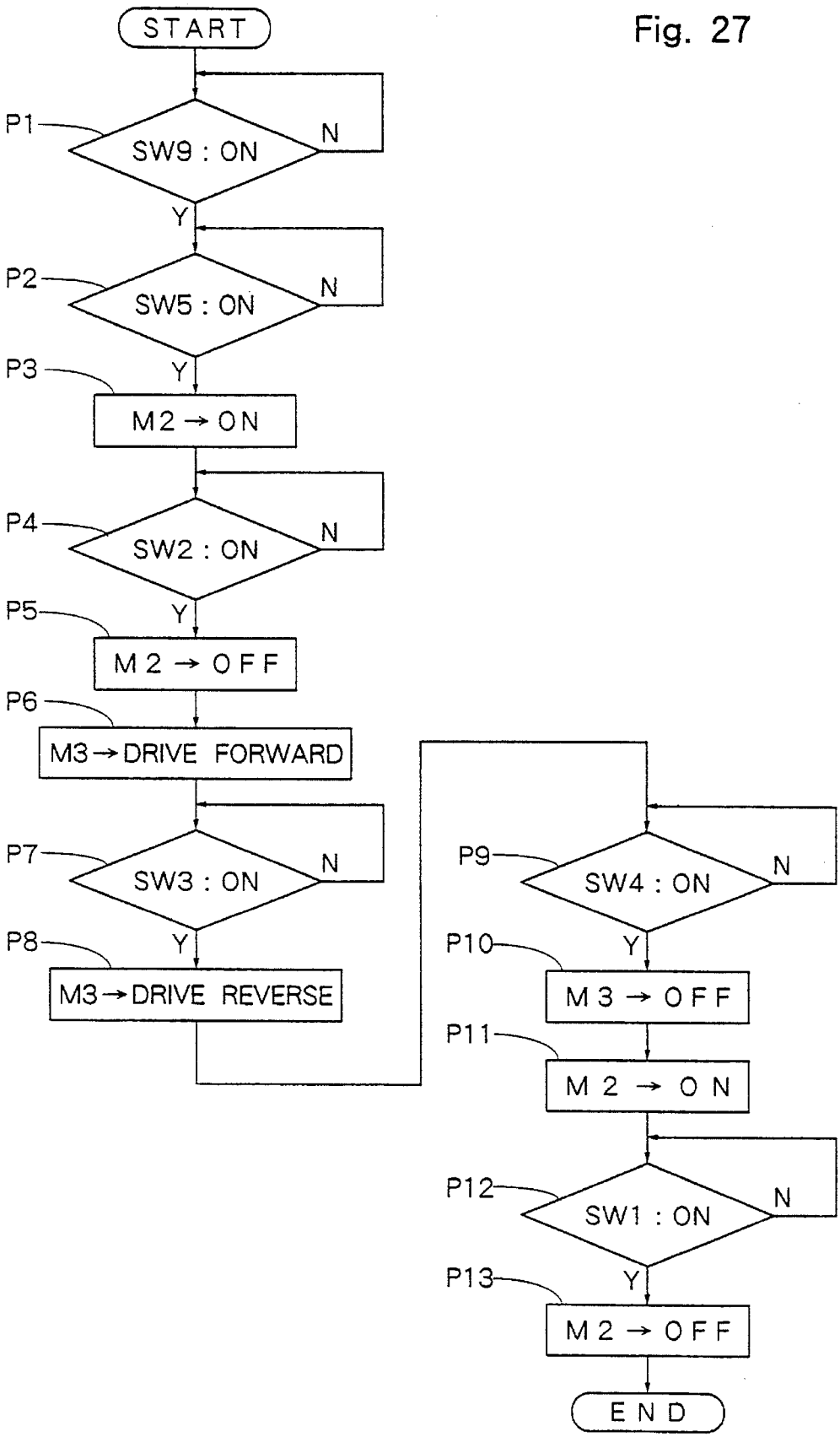
FIG. 27 is a flow chart explaining the operation for taking out the toner cartridge by the control means shown in FIGS. 22 and 23.

Next, described below with reference also to a flow chart of FIG. 27 is the operation for taking out the toner cartridge when the toner T in the container 100 of the cartridge 16 is all consumed and it becomes necessary to replace the toner cartridge 16 with a new one (the necessity for renewal is detected by, for example, detecting the toner in the toner conveying unit 6). To take out the toner cartridge 16 from the toner cartridge-holding means 14, the operator turns the toner cartridge take-out switch SW9 on. Then, the operation for taking out the toner cartridge 16 is started. The control means 440 checks whether the toner cartridge take-out switch SW9 is turned on or not (step P1) and makes sure whether the toner cartridge detection switch SW5 is turned on or not (step P2), when the toner cartridge take-out switch SW9 is turned on. This is to make sure that the toner cartridge 16 has been mounted on the toner cartridge-holding means 14. When the toner cartridge 16 has not been mounted on the toner cartridge-holding means 14, there is no need of executing the operation for taking out the toner cartridge. When the toner cartridge detection switch SW5 is turned on at the step P2, this means that the toner cartridge 16 has been mounted on the toner cartridge-holding means 14 and the program proceeds to a step P3 where the control means 440 drives the electric motor M2 of the hoist means. As the electric motor M2 is driven, the hoist gears 56(58) are rotated in the direction of arrow A from the state shown in FIG. 12, and the hoist pins 60(62) come into engagement with the upper walls 175*a*(175*b*) of the cam grooves 170*a*(170*b*) causing the toner cartridge 16 to move upwards. When the hoist pins 60(62) of the hoist gears 56(58) arrive at positions shown in FIG. 13 by being turned by about 30° from the lowest position which is the mounting position shown in FIG. 12, the second hoist pin position detection switch SW2 is turned on. After the electric motor M2 is driven, the control means 440 checks whether the second hoist pin position detection switch SW2 is turned on or not (step P4). When the second hoist pin position detection switch SW2 is not turned on, the electric motor M2 is continuously driven. When the second hoist pin position detection switch SW2 is turned on, the electric motor M2 is no longer driven (step P5). This state is shown in FIGS. 13 and 17 where the toner cartridge 16 is located at a shutter-moving position which is elevated by about 5 mm from the mounting position. After the electric motor M2 is brought into a halt, the control means 440 moves the electric motor M3 of the shutter-moving means in the forward direction (step P6). As the electric motor M3 is driven in the forward direction, the pulleys 80(82) rotate in the direction of arrow C in FIG. 17 as described earlier, whereby the timing belts 92(94) are moved in the direction of arrow D to move the shutter sliders 96(98) in the direction of arrow D. Due to this movement, the shutter sliders 96(98) come into engagement with both ends of the engaging member 134 of the shutter member 130 to draw the shutter 130 and, hence, to move the engaging member 134 up to a predetermined position on the side of the pulley 80 as shown in FIG. 18. As the shutter member 130 is drawn as described above, the toner discharge openings 150*a* and 150*b* are covered by the shutter sheet 132 of the shutter member 130. The first slider position detection switch SW3 is turned on when the shutter slider 96 is moved to the predetermined position on the side of the pulley 80 shown in FIG. 18. When the electric motor M3 is driven in the forward direction at the step P6, the control means 440 checks whether the first slider position detection switch SW3 is turned on or not (step P7). When the first slider position detection switch SW3 is not turned on, the electric motor M3 is continuously driven in the forward direction. When the first slider position detection switch SW3 is turned on, the electric motor M3 is driven in the reverse direction (step P8). As the electric motor M3 is driven in the reverse direction, the pulleys 80(82) are rotated in the direction of arrow E in the state shown in FIG. 18, whereby the shutter sliders 96(98) move in the direction of arrow F and are returned back to the predetermined position on the side of the pulleys 84(86) and at this position, the second slider position detection switch SW4 is turned on. After the electric motor M3 is driven in the reverse direction at the step P8, the control means 440 checks whether the second slider position detection switch SW4 is turned on or not (step P9). When the second slider position detection switch SW4 is not turned on, the electric motor M3 is continuously driven in the reverse direction. When the second slider position detection switch SW4 is turned on, the electric motor M3 is no longer driven in the reverse direction (step P10). When the shutter member 130 is thus drawn to cover the toner discharge openings 150*a* and 150*b* and the electric motor M3 is brought into a halt, the control means 440 drives the electric motor M2 (step P11). As the electric motor M2 is driven causing the hoist gears 56 and 58 to further rotate in the direction of arrow from the state of FIG. 13, the hoist pins 60(62) rotate upon engagement with the upper walls 175*a*(173*b*) of the cam grooves 170*a* and 170*b* causing the toner cartridge 16 to move upwards. When the toner cartridge 16 is moved to the attaching/detaching position shown in FIG. 10, the first hoist pin position detection switch SW1 is turned off. When the electric motor M2 is driven at the step P11, the control means 440 checks whether the first hoist pin position detection switch SW1 is turned on or not (step P12). When the first hoist pin position detection switch SW1 is not turned on, the electric motor M2 is continuously driven. When the first hoist pin position detection switch SW1 is turned on, the electric motor M2 is no longer driven (step P13). FIG. 10 illustrates the state where the electric motor M2 has not been driven. In this state, the hoist pins 60(62) are located at positions corresponding to the inlet/exit portions 172*a*(172*b*) of the cam grooves 170*a* and 170*b*, enabling the toner cartridge 16 to be replaced. As described above, the hoist means 50, sealing tape take-up means and shutter-moving means are controlled for their operations by the control means 440. Therefore, the toner cartridge 14 can be automatically brought to the mounting position or the attaching/detaching position by simply closing the toner cartridge mount switch SW8 or the toner cartridge take-out switch SW9.

In the foregoing were described in detail the electrostatic latent image-developing device and the toner cartridge used therefor constituted according to preferred embodiments of the present invention with reference to the accompanying drawings. It should, however, be noted that the present invention is in no way limited to the aforementioned embodiments only but can be varied or modified in a variety of other ways without departing from the scope of the invention.

What we claim is:

1. An electrostatic latent image-developing device comprising:

a toner cartridge equipped with a container having a toner discharge opening, a toner contained in said container, and a sealing tape for sealing said toner discharge opening, and a toner cartridge-holding means having a toner-receiving opening and allowing detachable mounting of said toner cartridge;

said toner discharge opening being positioned to face said toner-receiving opening when said toner cartridge is mounted at a predetermined mounting position of said toner cartridge-holding means; wherein said toner cartridge has a shutter member that is disposed on one edge side of said toner discharge opening and is so constituted as to move to the other edge side across said toner discharge opening thereby to cover said toner discharge opening; and said toner cartridge-holding means has a shutter-moving means that moves a front edge of said shutter member from one edge side to the other edge side of said toner discharge opening.

2. An electrostatic latent image-developing device according to claim 1, wherein said toner-receiving opening is larger than said toner discharge opening, a sealing member is disposed along a peripheral edge of said toner-receiving opening, said sealing member is brought into pressed contact with a lower wall of said container having said toner discharge opening, and said sealing tape is mounted on said lower wall on an inside of a press-contacted portion.

3. An electrostatic latent image-developing device according to claim 2, wherein said shutter member is disposed on an outside of said press-contacted portion.

4. An electrostatic latent image-developing device according to claim 2, wherein said toner cartridge-holding means is equipped with a means which moves said toner cartridge from the mounting position to a shutter-moving position where said sealing member is at least separated away from the lower wall of the container, and said shutter-moving means moves said shutter member when said toner cartridge is located at said shutter-moving position.

5. An electrostatic latent image-developing device according to claim 1, wherein said toner cartridge is equipped with a take-up shaft for taking up said sealing tape, and a portion of said take-up shaft for taking up the sealing tape is disposed in a closed space that is formed over a lower surface of said container.

6. An electrostatic latent image-developing device according to claim 1, wherein said shutter member is constituted by a flexible shutter sheet and a rigid engaging member attached to a front edge of said shutter sheet, and said shutter-moving means, upon engagement with said engaging member, moves the front edge of the shutter sheet from one edge side of said toner discharge opening to the other edge side thereof.

7. An electrostatic latent image-developing device according to claim 6, wherein the shutter-moving means has two shutter sliders that engage with said engaging member of said shutter member that are disposed by both sides of said toner-receiving opening so as to move along edges of said toner-receiving receiving opening, as well as a means that moves said shutter sliders along the edges of said toner-receiving opening.

8. An electrostatic latent image-developing device comprising:

a toner cartridge equipped with a container having a toner discharge opening, a toner contained in said container, and a sealing tape for sealing said toner discharge opening;

a toner cartridge-holding means having a toner-receiving opening and allowing detachable mounting of said toner cartridge;

a shutter member that is disposed on one edge side of said toner discharge opening of said toner cartridge and is so constituted as to move to the other edge side across said toner discharge opening thereby to cover said toner discharge opening;

a toner cartridge hoist means which moves said toner cartridge to an attaching/detaching position and to a predetermined mounting position;

a sealing tape take-up means for taking up said sealing tape;

a shutter-moving means that moves a front edge of said shutter member from one edge side to the other edge side of said toner discharge opening;

an instruction means for outputting a signal for attaching or detaching said toner cartridge; and a control means for controlling the operations of said toner cartridge hoist means, said sealing tape take-up means and said shutter-moving means based upon a signal from said instruction means;

wherein said control means, in response to a toner cartridge-mount signal from said instruction means, actuates said toner cartridge hoist means to move the toner cartridge to the predetermined mounting position and, then, actuates said sealing tape to take-up the sealing tape and, in response to a toner cartridge take-out signal, actuates said toner cartridge hoist means to bring the toner cartridge to a shutter-moving position that is elevated by a predetermined amount from the predetermined mounting position, then actuates said shutter-moving means to move a tip of the shutter member from one edge side to the other edge side of said toner discharge opening, and then actuates said toner cartridge hoist means to bring the toner cartridge to the attaching/detaching position.

9. A toner-cartridge that is detachably mountable to a toner cartridge-holding means of an electrostatic latent image-developing device, the toner cartridge-holding means having a toner-receiving opening and a shutter-moving means including a motor, said toner cartridge comprising:

a toner contained in said container, a sealing tape which is stuck to a peripheral edge of the toner discharge opening in a manner that it can be peeled from said toner discharge opening, and a shutter member that is disposed on one edge side of said toner discharge opening and is so constituted as to move to the other edge side across said toner discharge opening, said shutter member having a front edge and an engaging member on said front edge for engaging with the shutter-moving means for moving said shutter member from said one edge side to said other edge side of said toner discharge opening by the motor of the shutter-moving means.

10. A toner cartridge comprising:

a container having a toner discharge opening, a toner contained in said container, a sealing tape which is stuck to a peripheral edge of said toner discharge opening in a manner that it can be peeled from said toner discharge opening, a shutter member that is disposed on one edge side of said toner discharge opening and is so constituted as to move to the other edge side across said toner discharge opening, a take-up shaft to which a front edge of said sealing tape is coupled, and a sealing tape take-up portion of said take-up shaft, said sealing tape take-up portion being disposed in a closed space that is formed over a lower wall of said container.

11. A toner cartridge comprising:

a container having a toner discharge opening, a toner contained in said container, a sealing tape which is stuck to a peripheral edge of said toner discharge opening in a manner that it can be peeled from said toner discharge opening, and a shutter member that is disposed on one edge side of said toner discharge opening and is so constituted as to move to the other edge side across said toner discharge opening, said shutter member including a flexible shutter sheet and a rigid engaging member attached to a front edge of said shutter sheet.

* * * * *